US007139522B2

(12) United States Patent
Ohki et al.

(10) Patent No.: US 7,139,522 B2
(45) Date of Patent: Nov. 21, 2006

(54) IMAGE FORMING APPARATUS

(75) Inventors: Yasushi Ohki, Ebina (JP); Yoshio Kanesawa, Nakai-machi (JP); Yutaka Nogami, Nakai-machi (JP); Yoshisada Nakamura, Fujinomiya (JP); Tadakazu Edure, Ebina (JP)

(73) Assignees: Fuji Xerox Co., Ltd., Tokyo (JP); Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 11/191,960

(22) Filed: Jul. 29, 2005

(65) Prior Publication Data

US 2005/0276642 A1 Dec. 15, 2005

Related U.S. Application Data

(62) Division of application No. 10/724,156, filed on Dec. 1, 2003, now Pat. No. 6,934,507.

(30) Foreign Application Priority Data

Dec. 24, 2002 (JP) ..... 2002-372867
Dec. 24, 2002 (JP) ..... 2002-372886

(51) Int. Cl.
*G03G 15/00* (2006.01)

(52) U.S. Cl. ..... 399/384; 399/385; 399/406

(58) Field of Classification Search ..... 399/384, 399/385, 406
See application file for complete search history.

(56) References Cited

U.S. PATENT DOCUMENTS 3,914,097 A 10/1975 Wurt
4,632,585 A * 12/1986 Oyamatsu et al. ..... 400/613
4,849,824 A * 7/1989 Sakuragi et al. ..... 358/296
5,160,960 A * 11/1992 Ibuchi et al. ..... 355/408
5,372,984 A 12/1994 Yamauchi et al.
5,708,345 A * 1/1998 Kramer et al. ..... 318/696
5,920,759 A 7/1999 Ushiroji et al.
6,094,560 A 7/2000 Thomas
6,164,203 A * 12/2000 Keller ..... 101/407.1
6,229,983 B1 * 5/2001 Sawada ..... 399/385
6,519,441 B1 * 2/2003 Sawada ..... 399/384
2002/0130941 A1 * 9/2002 Tanaami ..... 347/104
2003/0001947 A1 * 1/2003 Motooka ..... 347/264
2004/0067082 A1 4/2004 Uehara et al.

FOREIGN PATENT DOCUMENTS

JP A 5-147793 6/1993
JP A 5-216322 8/1993

(Continued)

*Primary Examiner*—Andrew H. Hirshfeld
*Assistant Examiner*—Marvin Crenshaw
(74) *Attorney, Agent, or Firm*—Oliff & Berridge, PLC

(57) ABSTRACT

Provided is an image forming apparatus, in which liable to produce remaining curl, highly effective curl correction is performed. The image forming apparatus includes: a roll receiving portion for receiving a continuous recording sheet wound into a roll shape; a sheet transporting portion for transporting the continuous recording sheet from the roll receiving portion; a cutting portion for cutting the continuous recording sheet sent out into a desired size; an image forming portion for forming a toner image on the recording sheet (which has been cut); a fixing portion for fixing the toner image to the recording sheet by heating the recording sheet on which the toner image is formed; a cooling portion for cooling the recording sheet to which the toner image has been fixed; and a curl correcting portion for correcting a curl of the recording sheet when the recording sheet is cooled.

12 Claims, 25 Drawing Sheets

FOREIGN PATENT DOCUMENTS

| | | | |
|---|---|---|---|
| JP | A 10-213984 | | 8/1998 |
| JP | 11-322141 | * | 11/1999 |
| JP | 2005132536 A | * | 5/2005 |

* cited by examiner

● PEELED AFTER COOLING ON FLAT SURFACE (@RESIN COATED PAPER)

▲ PEELED WITHOUT COOLING (@RESIN COATED PAPER)

○ PEELED AFTER COOLING ON FLAT SURFACE (@PLAIN PAPER)

△ PEELED WITHOUT COOLING (@PLAIN PAPER)

IMAGE FORMING APPARATUS

This is a Division of Application Ser. No. 10/724,156 filed Dec. 1, 2003 now U.S. Pat. No. 6,934,507. The entire disclosure of the prior application is hereby incorporated by reference herein in its entirety.

FIELD OF THE INVENTION AND RELATED ART STATEMENT

The present invention relates to a color image forming apparatus adopting an electrophotographic process, such as a color copying machine, a color printer, or a color facsimile, and more particularly to an image forming apparatus using a roll-type recording sheet.

In an image forming apparatus, such as an electronic copying machine or a laser printer, which forms an image on a recording paper using an electrophotographic recording process, multiple feeding cassettes and multiple feeding trays are mounted in a feeding portion, and a standard-size recording paper is selected according to a size of an original or a reduction/enlargement ratio to be fed from each of the above recording paper receiving mechanisms.

To the contrary, printing may be performed on a non-standard-size recording paper, a long-sized recording paper such as a banner, a recording paper having a different texture (for example, a coated paper formed by coating a base paper with a resin layer in order to produce a print quality exhibiting a high gloss appearance as of a photograph), or the like. In this case, multiple roll-type recording papers having mutually different sizes and textures are mounted in the feeding portion, making it possible to prepare a recording paper having an arbitrary length by cutting a paper rolled out from the roll paper according to the length of the original.

In the case of the image forming apparatus that cuts the roll paper into a desired size to prepare a recording paper as described above, there is a problem of curl peculiar to the roll paper. If the recording paper is transported without correcting the curl, the curl remains even after the recording paper is outputted, which leads to quality degradation. Therefore, the image forming apparatus using a roll paper generally corrects the curl before transporting the recording paper. However, the roll paper changes in roll paper diameter (curvature) depending upon its remaining amount, so that a curl amount also changes, making it difficult to stably correct the curl that changes from a state with a large roll paper remaining amount to a state with a small roll paper remaining amount.

In view of the above problem at the time of using a roll paper, FIGS. 16(*a*) and 16(*b*) show a conventional decurling device using a resilient member for curl correction. The decurling device uses the resilient member for a decurling roll, and therefore has an object to utilize the deformation of the resilient member for the curl correction regardless of varying roll paper diameters (varying curvatures).

Meanwhile, the present invention relates to an image forming apparatus adopting an electrophotographic process, such as a copying machine, a printer, a facsimile, or a multifunction device integrating the functions of these apparatuses. More particularly, the present invention also relates to an image forming apparatus capable of using a recording paper coated with a thermoplastic resin.

The image forming apparatus adopting an electrophotographic process, such as a copying machine or a printer, is widely known and put into practice in various fields.

Further, in recent years, a full-color image is increasingly demanded to have a higher image quality, and a technique for obtaining a full-color image having a high gloss is introduced. Up to now, there is proposed, for example, a method of forming a color image by transferring color toner made of a thermoplastic resin onto the surface of a recording sheet provided with a resin formed of a thermoplastic resin, and heat-melting the color toner.

According to the above-mentioned technique, a color toner image formed of a thermoplastic resin is transferred onto the surface of the recording sheet provided with a resin layer formed of a thermoplastic resin, and a heat-resistant film is pressurized against the recording sheet, subjected to heating followed by cooling in a close contact state with a pressurizing belt, and then peeled off from the film, thereby embedding the toner image in the resin layer. Thus, the toner image is embedded into the resin layer of the recording medium surface, and the recording medium surface exhibits smoothness and a high gloss, so that a color image with a high image quality can be obtained. Up to now, as such type of fixing belt, it is proposed to use a silicone rubber having a resilience on the surface of a heat-resistant endless belt, a fluoro rubber of high releasing property, or the like.

However, there is still a problem with a roll paper that is liable to produce remaining curl such as a multi-layered coated paper or a cardboard paper, in that even if the decurling roll composed of a resilient member and included in the conventional decurling device is used, curls occurring in roll papers varying diameters (varying curvatures) cannot be corrected sufficiently, and the curl correction is not stably performed.

SUMMARY OF THE INVENTION

The present invention has been made in view of the above-mentioned technical problem, and provides an image forming apparatus, in which even when using a roll-type recording sheet liable to produce remaining curl such as a multi-layered coated paper or a cardboard paper, highly effective curl correction is performed, making it possible to stably obtain a high print quality regardless of varying roll paper diameters.

An image forming apparatus according to the present invention includes: a roll receiving portion for receiving a continuous recording sheet wound into a roll shape; a sheet transporting portion for transporting the continuous recording sheet from the roll receiving portion; a cutting portion for cutting the continuous recording sheet that is sent out, into a desired size; an image forming portion for forming a toner image on the recording sheet (which has been cut); a fixing portion for fixing the toner image to the recording sheet by heating the recording sheet on which the toner image is formed; a cooling portion for cooling the recording sheet to which the toner image has been fixed; and a curl correcting portion for correcting a curl of the recording sheet when the recording sheet is cooled. By structuring the image forming apparatus as described above, the recording sheet, which has reached a relatively high temperature after the fixing, has its curl corrected while being cooled, thereby enabling effective curl correction. Also, because the curl correction can be effectively performed, there is no need to raise the fixing temperature for the curl correction. Thus, a degree of flexibility increases in selecting the material of the recording sheet (for example, in selecting a resin composing the surface layer of the recording sheet).

Specifically, the cooling portion includes a flat region for retaining the sheet flat, and cools the recording sheet from at least one side surface thereof in the flat region (by a heat sink, a blowing fan, or the like). The curl correcting portion may be a pressing member for retaining the recording sheet, which is transported to the flat region, flat. More specifically, the cooling portion is a heat sink including a flat region, the curl correcting portion is a pressing roll for pressing the recording sheet transported to the flat region toward a flat region side, and the recording sheet can be transported with its toner image surface facing toward the flat region side. Further, in order to obtain the curl correction effect by stretching the recording sheet in a transport direction, the curl correcting portion includes multiple pressing rolls that are rotatable and press the recording sheet transported to the flat region toward a flat region side. Further, of the multiple pressing rolls, the pressing roll on a downstream side of the recording sheet in a transport direction may have a rotational speed higher than that of the pressing roll on an upstream side thereof in the transport direction.

Note that in order to realize smooth transport of the recording sheet, the intervals between the multiple pressing rolls in a transport direction of the recording sheet are preferably designed to be shorter than the minimum length of the recording paper in its transport direction. Also, the heat sink may include a blowing member for blowing the heat sink with air.

As another specific example, the image forming apparatus may have a structure in which the fixing portion, the cooling portion, and the curl correcting portion compose a belt fixing device, the belt fixing device including: a heating roll; a tension roll; an endless fixing belt that is rotatably stretched onto the heating roll and the tension roll; a pressurizing rotating member that is press-contacted with the heating roll through the endless fixing belt; and a heat sink that contacts the flat region from an inside of the flat region, the flat region being arranged on a downstream side of the heating roll in a rotational direction of the endless fixing belt, and in which the recording sheet is brought into close contact with the endless fixing belt in a press-contact portion between the heating roll and the pressurizing rotating member, and transported and cooled while being in close contact with the endless fixing belt.

Further, an image forming apparatus according to the present invention may include: a roll receiving portion for receiving a continuous recording sheet wound into a roll shape; a sheet transporting portion for transporting the continuous recording sheet from the roll receiving portion; a cutting portion for cutting the continuous recording sheet that is sent out, into a desired size; an image forming portion for forming a toner image on a recording sheet; a first fixing portion for fixing the toner image to the recording sheet by heating the recording sheet on which the toner image is formed; a second fixing portion for fixing the toner image to the recording sheet by heating the recording sheet on which the toner image is formed; a cooling portion for cooling the recording sheet to which the toner image has been fixed; a curl correcting portion for correcting a curl of the recording sheet when the recording sheet is cooled; and a selecting portion for selecting between a first mode in which the recording sheet on which the toner image is formed is passed through only the first fixing portion and a second mode in which the recording sheet is passed through all of the first fixing portion, the second fixing portion, the cooling portion, and the curl correcting portion.

Also in a case where the image forming apparatus includes the second fixing portion as described above, the image forming apparatus may have a structure in which the second fixing portion, the cooling portion, and the curl correcting portion compose a belt fixing device, the belt fixing device including: a heating roll; a tension roll; an endless fixing belt that is rotatably stretched between the heating roll and the tension roll; a pressurizing rotating member that is press-contacted with the heating roll through the endless fixing belt; and a heat sink that contacts the flat region from an inside of the flat region, the flat region being arranged on a downstream side of the heating roll in a rotational direction of the endless fixing belt, and in which the recording sheet is brought into close contact with the endless fixing belt in a press-contact portion between the heating roll and the pressurizing rotating member, and transported and cooled while being in close contact with the endless fixing belt. Further, the selecting portion can select between the first mode and the second mode based on a type of the recording sheet (whether a resin layer is provided or not, etc.). For example, the selecting portion can select the second mode in a case where the recording sheet is obtained by cutting the continuous recording sheet wound into a roll shape.

In each image forming apparatus as described hereinabove, the cooling portion can cool the recording sheet from a surface side of the recording sheet on which the toner image is formed.

Further, the toner image may be formed on an outer surface of the continuous recording sheet wound into a roll shape. Further, a surface of the continuous recording sheet wound into a roll shape may be coated with a thermoplastic resin layer; and the toner image may be formed on the surface coated with the thermoplastic resin layer. Further, a surface of the continuous recording sheet wound into a roll shape may be coated with a thermoplastic resin layer, the toner image may be formed on the surface coated with the thermoplastic resin layer, and the toner image may be embedded into the thermoplastic resin layer by fixing. Further, a surface of the continuous recording sheet wound into a roll shape may be coated with a thermoplastic resin layer, the toner image may be formed on the surface coated with the thermoplastic resin layer, the toner image may be embedded into the thermoplastic resin layer by fixing, and the toner image may be fixed to an inside of the thermoplastic resin layer by cooling. Further, the continuous recording sheet wound into a roll shape may include: a base formed by coating one of one side and both sides of an original with a polyolefin resin coated layer; and a thermoplastic resin layer coated on a surface of the base, and the toner image may be formed on the surface coated with the thermoplastic resin layer.

Further, the recording sheet on which a residual curl remains after curl correction is preferably curled such that a surface on which the toner image is formed faces outward.

On the other hand, in the case of using the recording sheet provided with a resin layer made of a thermoplastic resin, the following technical problems exist. Firstly, a recording sheet having a resin layer on one side surface is wound around the fixing device due to erroneous setting of the front and reverse sides of the recording sheet, thereby causing jamming (Problem 1). Secondly, the apparatus becomes short of paper trays due to use of various sizes and types of papers (Problem 2). Thirdly, a recording sheet may contain moisture, thereby causing a transfer failure or winding of the recording sheet around the fixing device, resulting in jamming (Problem 3).

With regard to Problem 1, the winding occurs due to the structure of the fixing device according to a mechanism described below. FIGS. 28(*a*) and 28(*b*) show a fixing device composed of two rolls (a heating roll and a pressurizing roll). As the fixing device, in addition to the roll fixing device as shown in FIGS. 28(*a*) and 28(*b*), a fixing device using a belt as shown in FIG. 29 is disclosed in Patent Document 2. With the belt-type fixing device, similarly to the roll fixing device, a heating member and a pressurizing member are contacted with each other (the contact portion is referred to as a nip), toner is melted using heat and pressure, the recording sheet is peeled off from a fixing member by distortion generated at a nip exit, and the toner is fixed to the recording sheet.

Here, the roll fixing device is described as an example. The roll fixing device has a structure such that the so-called heating roll that contacts an image is softer than the pressurizing roll. The heating roll of FIGS. 28(*a*) and 28(*b*) has a load imparted thereto by a not-shown load imparting mechanism, and is designed to dig into the heating roll. In the nip portion (hereinafter, referred to as "nip region"), the roll is distorted, and the recording sheet is separated from the heating roll by use of a force generated at the nip exit to release the distortion. The transported recording sheet and the unfixed toner image are transported into the nip, and the thermoplastic resin and the toner are melted under heat within the nip and adhere to a recording medium such as paper.

At this time, an adhesive force also occurs between the heating roll and the toner. However, a water repellency of a heating roll surface, a distortion amount, and a rigidity of the recording sheet are used to control the posture of the recording sheet at the nip exit. Thus, the recording sheet passes through the nip and is delivered to an outside of the apparatus.

However, if the recording sheet having a resin layer made of a thermoplastic resin is printed by erroneously setting the front and reverse sides of the recording sheet, the adhesive force due to the thermoplastic resin melted within the nip causes the recording sheet to wind around the pressurizing roll surface at the nip exit (see FIG. 28(*b*))

Here, the roll fixing device is described as an example. However, the fixing device using a belt as shown in FIG. 29 has the similar structure (see an enclosed portion A of FIG. 29) as the roll fixing device, in which distortion is imparted to the recording sheet at the nip exit so as to peel off the recording sheet from the heating member. Therefore, the erroneous setting of the front and reverse sides of the recording sheet causes the recording sheet to be wound around the fixing roll.

Meanwhile, a conventional belt fixing device should be noted. In the fixing device, an endless belt 4 is stretched between a heat roll 2 provided to oppose a pressurizing roll 1 and an idle roll 3. The toner image is melted by a heating-pressurizing roll pair, and air is taken into a cooling roll that performs cooling while being in contact with the belt. The belt, the toner, and the paper are cooled through the cooling roll, thereby hardening the image in accordance with smoothness of a belt surface. Accordingly, a full-color image with a high gloss can be obtained.

However, even with the fixing device disclosed in Patent Document 1, the erroneous setting of the front and reverse sides of the recording sheet causes the pressurizing roll opposing the belt to be wound around by the recording sheet.

As a measure for preventing the erroneous setting, for example, there is a method of printing identifying marks or the like on the front surface and the reverse surface of the recording sheet as in an OHP sheet (Color OHP V524 manufactured by Fuji Xerox Co., Ltd.). However, even this method is not effective to prevent the erroneous setting. Also, there arises a new problem in that the manufacturing cost for the recording sheet increases. Further, if the identifying marks are put on a paper whose-basic color is white, the marks are left on the printed document, resulting in an unfavorable appearance. Furthermore, the recording sheet with the identifying marks is not applicable to a print with such a quality requirement that there should be no margins, such as a photograph.

As to the shortage of the paper trays exemplified as Problem 2, a copying machine or a printer generally has about five stages of paper trays (capable of receiving five different types of papers such as A4, A3, and B5 papers). However, if a glossy paper is used in addition to a plain paper, because (1) different types of papers are used, and (2) also different sizes are used (A and B of office standard sizes, L of a photographic standard size, an octavo, and the like are different in size), there are problems in that the types of papers to be received are limited, or if trays for all the types and sizes of papers are prepared, the printing apparatus becomes larger.

Described below is Problem 3 that the recording sheet containing moisture causes the transfer failure or winding of the recording sheet around the fixing device. If the recording sheet contains moisture, its electric characteristics (surface resistance and volume resistance) are reduced, causing a reduction in density and density unevenness. Also, if the content of moisture in the recording sheet becomes higher, the rigidity of the recording sheet is reduced, causing the transfer failure or winding of the recording sheet around the fixing device.

The present invention has been made in view of the above-mentioned problems as well, and provides an image forming apparatus capable of avoiding erroneous setting of the front and reverse sides of the recording sheet. Further, the invention provides an image forming apparatus capable of avoiding shortage of paper trays. Furthermore, the invention provides an image forming apparatus capable of preventing a recording sheet from containing moisture.

Further, an image forming apparatus according to the present invention includes: a sheet feeding portion for feeding a recording sheet; and an image forming portion for forming a toner image on the recording sheet, the sheet feeding portion serving as a roll sheet feeding portion for feeding a continuous recording sheet wound into a roll shape. Further, the image forming apparatus may include multiple roll sheet feeding portions for feeding the continuous recording sheet wound into a roll shape, different types of continuous recording sheets that are wound into a roll shape maybe accommodated in the multiple roll sheet feeding portions, and the multiple continuous recording sheets wound into a roll shape may have different sizes in a direction of a roll shaft.

Further, the sheet feeding portion may include: a roll sheet feeding portion for feeding the continuous recording sheet wound into a roll shape; and a standard-size sheet feeding portion for feeding a standard-size recording sheet that is placed flat, the continuous recording sheet and the standard-size recording sheet being fed selectively. Further, the roll sheet feeding portion may be detachably mountable to an image forming apparatus main body.

Further, the roll sheet feeding portion may include a roll retaining portion for rotatably retaining the continuous recording sheet wound into a roll shape. In addition, the roll sheet feeding portion may further include: a roll transporting portion for transporting the continuous recording sheet from the roll retaining portion; and a cutting portion for cutting the transported continuous recording sheet into a desired size.

Further, a material of a front surface of the continuous recording sheet may be different from a material of a reverse surface of the continuous recording sheet, and at least one of the continuous recording sheet wound into a roll shape and the roll retaining portion may include a reverse mounting prohibiting portion for regulating a mounting direction of the continuous recording sheet so as to transport the continuous recording sheet while setting the front and reverse surfaces of the continuous recording sheet correctly.

Further, at least one side surface of the continuous recording sheet may have a resin layer. Further, the continuous recording sheet may be wound into a roll shape with the resin layer facing outward. As a more specific example of the resin layer, the image forming apparatus may have, on at least one side surface of the continuous recording sheet, a toner receiving layer made of a thermoplastic resin. Further, the image forming portion may form the toner image on a receiving layer side of the continuous recording sheet. Further, the image forming apparatus may further include a smoothing fixing portion that includes a fixing belt, the smoothing fixing portion fixing the toner image to the recording sheet by bringing a resin layer side of the recording sheet into close contact with the fixing belt and then cooling the recording sheet to peel the recording sheet from the fixing belt.

BRIEF DESCRIPTION OF THE DRAWINGS

Preferred embodiments of the present invention will be described in detail based on the following drawings, wherein.

DETAILED DESCRIPTION OF THE PREFERRED EMBODIMENTS

Hereinafter, referring to the accompanying drawings, embodiments of the present invention will be described.

Embodiment 1

Figure 1:
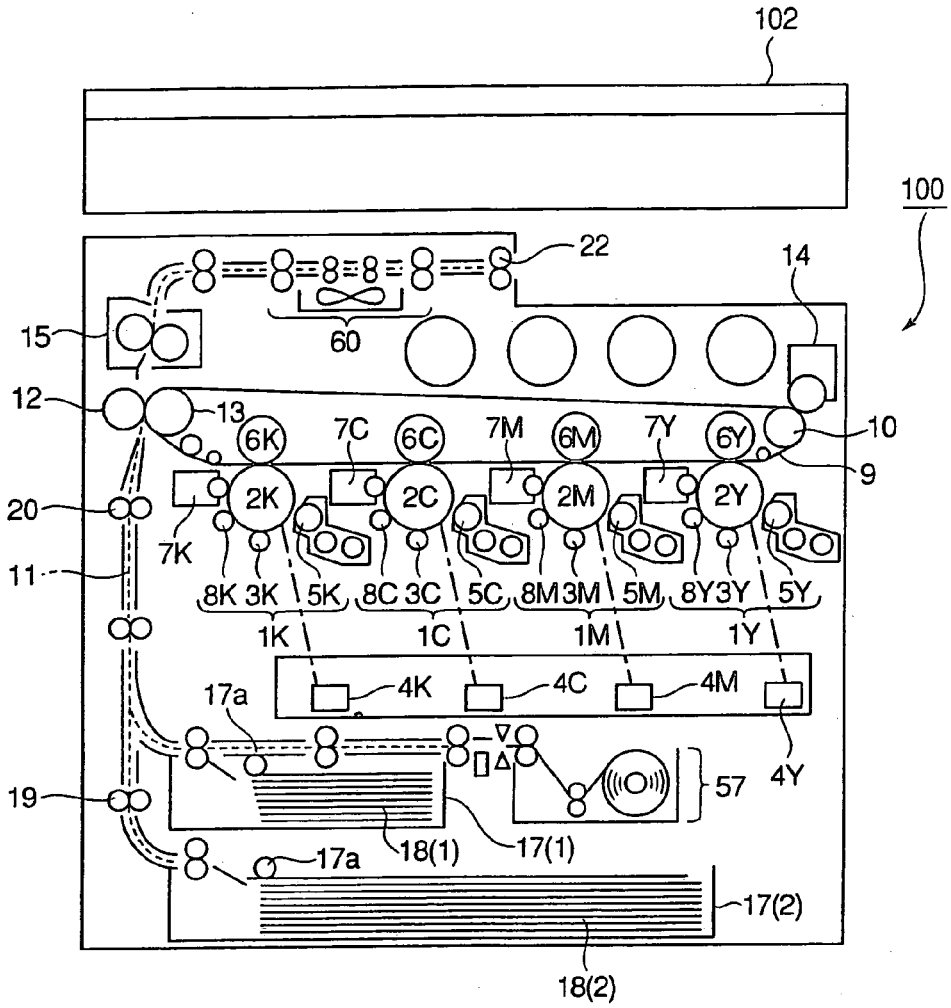
FIG. 1 is a schematic structural diagram showing an image forming apparatus according to Embodiment 1 of the present invention.

FIG. 1 is a schematic structural diagram of a tandem-type color image forming apparatus 100 according to Embodiment 1 of the present invention.

Inputted into the image forming apparatus 100 are color image information sent from a not-shown personal computer or the like, color image information of a color original read by an image data input device or an image reading device 102, or the like information. Then, an image processing is performed on the inputted image information.

Electrophotographic image forming units (image forming portion) 1Y, 1M, 1C, and 1K for forming toner images in yellow, magenta, cyan, and black, respectively, are disposed in series in the stated order with respect to an advancing direction of an endless intermediate transfer belt (image forming portion) 9 that is stretched by multiple tension rolls 10. Also, the intermediate transfer belt 9 is inserted to pass between electrostatic latent image bearing members 2Y, 2M, 2C, and 2K of the respective electrophotographic image forming units 1Y, 1M, 1C, and 1K, and transfer units (image forming portions) 6Y, 6M, 6C, and 6K that are disposed to oppose the respective electrostatic latent image bearing members 2Y, 2M, 2C, and 2K.

Hereinbelow, description will be made of an operation for forming an image on the intermediate transfer belt 9 by taking as a typical example the electrophotographic image forming unit 1Y for forming a yellow toner image.

First, the electrostatic latent image bearing member 2Y has its surface uniformly charged by a uniform charger 3Y. Then, an exposure device 4Y performs image exposure corresponding to a yellow image to form an electrostatic latent image corresponding to the yellow image on the surface of the electrostatic latent image bearing member 2Y.

A developing device 5Y forms a yellow toner image based on the electrostatic latent image corresponding to the yellow image, and the yellow toner image is transferred onto an intermediate transfer belt 9 by electrostatic attraction and a press-contact force of a primary transfer roll 6Y composing a part of a primary transfer unit. Yellow toner remaining on the electrostatic latent image bearing member 2Y after the transfer is scraped off by an electrostatic latent image bearing member cleaning device 7Y. The charge is eliminated from the surface of the electrostatic latent image bearing member 2Y by a charge eliminator 8Y. After that, the surface is recharged by the uniform charger 3Y for the subsequent image-forming process.

In the image forming apparatus 100 for forming a multicolor image, at a timing set in consideration of relative positional differences among the respective electrophotographic image forming units 1Y, 1M, 1C, and 1K, the above-mentioned image forming steps are similarly performed on the electrophotographic image forming units 1M, 1C, and 1K. Thus, a full-color toner image is formed on the intermediate transfer belt 9.

The full-color toner image formed on the intermediate transfer belt 9 is transferred onto a recording paper transported to a secondary transfer position at a predetermined timing, by electrostatic attraction and by a press-contact force acting between a backup roll 13 for supporting the intermediate transfer belt 9 and a secondary transfer roll 12 composing a part of a secondary transfer unit that press-contacts the backup roll 13.

Used here as the recording paper to be transported is a standard-size recording paper 18 that is cut into a standard size in advance, or a roll recording paper 50 that is cut into a desired length as required.

As shown in FIG. 1, the standard-size recording paper 18 having a predetermined size is fed by a feeding roll 17*a* from the standard-size recording paper feeding cassette 17 as a recording paper receiving portion which is arranged in a lower portion inside the image forming apparatus 100. Note that in this embodiment, standard-size recording papers 18(1) and 18(2), which are plain papers different in size, are received in standard-size recording paper feeding cassettes 17(1) and 17(2), respectively. Also, at the time of outputting a photographic image or the like, a roll paper cut into a predetermined size is fed from a roll recording paper feeding cassette 57 as the recording paper receiving portion which is arranged in the lower portion inside the image forming apparatus 100.

Figure 2:
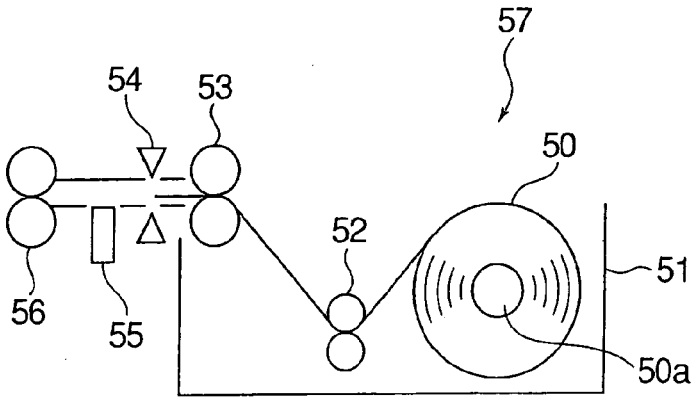
FIG. 2 is a schematic structural diagram showing a roll recording paper feeding cassette.

FIG. 2 is a diagram for explaining a structure of the roll recording paper feeding cassette 57. As shown in FIG. 2, the roll recording paper feeding cassette 57, includes: a roll receiving portion 51 for receiving the roll recording paper 50 wound around a roll shaft 50*a* into a roll shape; a pre-correction roll 52 for correcting the curl of the roll recording paper 50 in advance; a feeding roll (sheet transporting portion) 53 for transporting a leading end of the roll recording paper 50; a cutting mechanism (cutting portion) 54 for cutting the roll recording paper 50 into a predetermined size; a paper sensor 55 for detecting presence/absence of the roll recording paper 50, which is provided on a transport path of the roll recording paper 50; and a transporting roll 56 for transporting the roll recording paper 50 that has been cut out. Note that a toner image is formed on the outer side surface of the roll recording paper 50.

Figure 3:
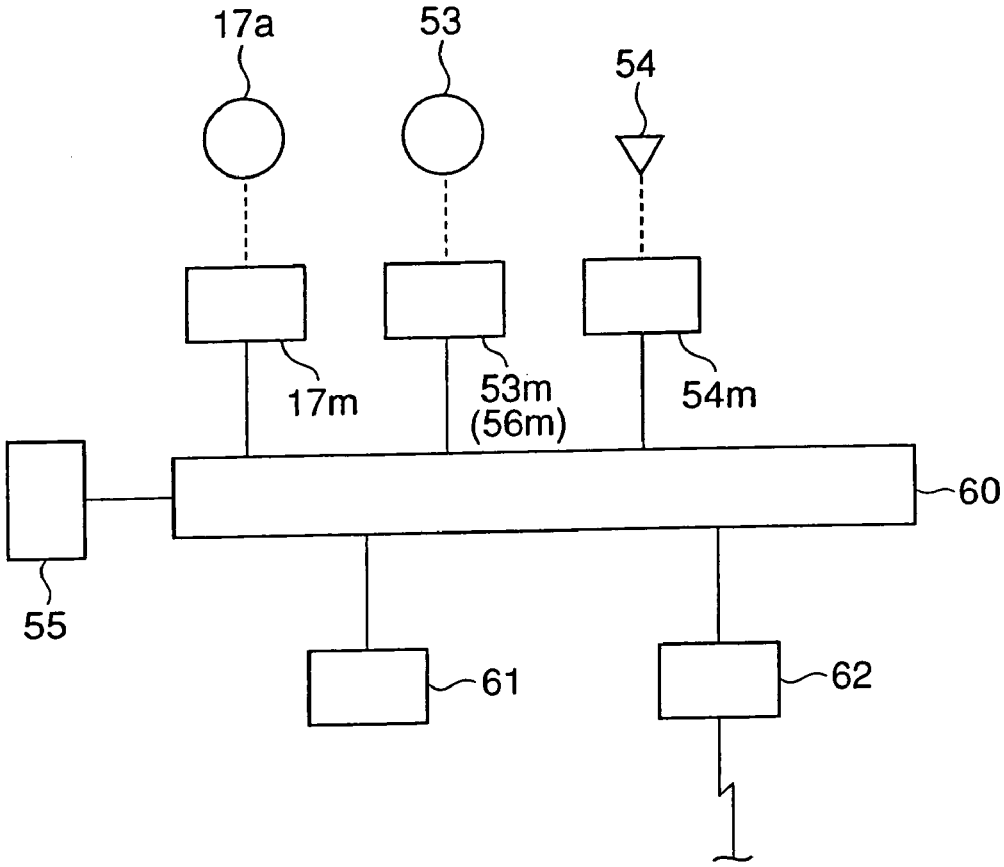
FIG. 3 is a block diagram for explaining a recording paper selection control system.

FIG. 3 is a block diagram for explaining a paper selection control system of the image forming apparatus 100 according to this embodiment. The construction of the paper selection control system is centered on a control portion 60. Subject to measurement by the control portion 60 are a presence/absence signal indicating the presence/absence of the roll recording paper 50 which is sent from the paper sensor 55, a paper designating signal sent from a user interface 61 of the image forming apparatus 100 such as a liquid crystal touch panel or an operation button, and an image formation instructing signal sent from a not-shown personal computer or the like via an information communication control portion 62. Also, the control portion 60 performs control on the following: power supply to a feeding roll motor 17*m* for driving the feeding roll 17*a;* power supply to a feeding roll motor 53*m* for driving the feeding roll 53; and power supply to a cutting motor (or cutting solenoid) 54*m* for driving the cutting mechanism 54.

With the paper selection control system, the paper selection is performed as follows. First, when the paper designating signal or the image formation instructing signal is transmitted from a user interface, a personal computer, or the like, the control portion 60 drives and controls respective functional components based on these signals. For example, when the standard-size recording paper 18(1) is designated as the recording paper, the control portion 60 supplies a power to the feeding roll motor 17*m* corresponding to the standard-size recording paper 18(1), and the standard-size recording papers 18(1) are fed sheet by sheet from the standard-size recording paper feeding cassette 17(1).

Also, when the roll recording paper 50 having a length L in the transport direction is designated as the recording paper, the control portion 60 supplies power to the feeding roll motor 53*m* corresponding to the feeding roll 53, and the roll recording paper 50 is transported from the roll receiving portion 51. Then, upon determining that the distance from the leading end of the roll recording paper 50 to the cutting mechanism 54 is "L", through computation based on a leading end detection timing outputted from the paper sensor 55, rotational speed of the feeding roll 53, or the like, power is supplied to the motor (or cutting solenoid) 54*m*, and the roll recording paper 50 is cut. Thus, the roll recording papers 50 having a desired size are supplied sheet by sheet.

Note that the curl of the roll recording paper 50 having the length L is mitigated to some extent by the action of the pre-correction roll 52. The control portion 60 includes a central processing unit, a recording unit, and an input/output unit. Thus, based on a control program stored in the recording device, the control portion 60 performs information processing and information communication with other components through various information buses or interface devices, thereby achieving the above-mentioned control.

Subsequently, the recording paper (the standard-size recording paper 18 or the roll recording paper 50) is transported to a secondary transfer position on the intermediate transfer belt 9 at a predetermined timing by multiple transporting rolls 19 and a registration roll 20. Then, as described above, a full-color image is transferred at once onto the recording paper by the backup roll 13 and the secondary transfer roll 12 as the secondary transfer unit. Also, after being separated from the intermediate transfer belt 9, the recording paper onto which the full-color toner image has been transferred from the intermediate transfer belt 9 is transported to a fixing device (fixing portion) 15 disposed on a downstream side of the secondary transfer unit, and the toner image is fixed to the recording paper with heat and pressure by the fixing device 15.

Further, residual toner, which has not been transferred onto the recording paper by the secondary transfer unit and remains on the intermediate transfer belt 9, is carried to an intermediate transfer member cleaning device 14 while keeping adhering to the intermediate transfer belt 9, and removed from the intermediate transfer belt 9 by the intermediate transfer member cleaning device 14 to prepare for the subsequent image forming process.

Figure 4:
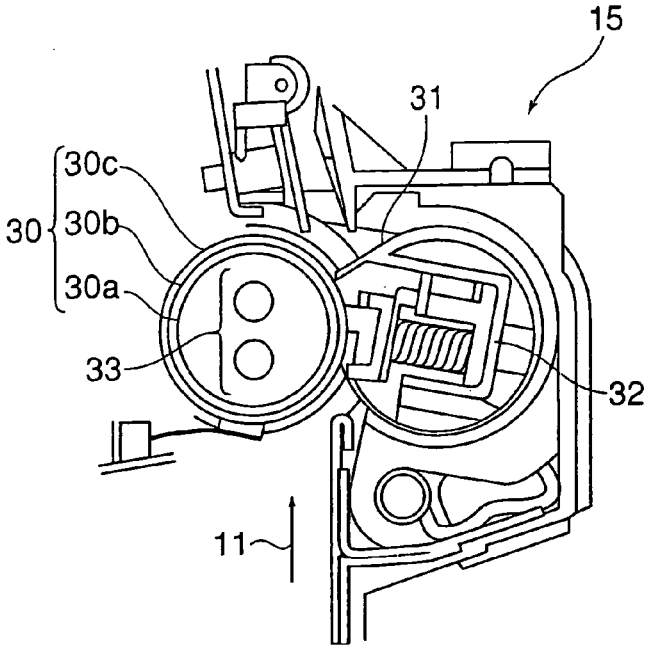
FIG. 4 is a schematic structural diagram showing a fixing device.

FIG. 4 is a diagram for explaining a structure of the fixing device 15 in more detail. The fixing device 15 is a pressurizing belt-type fixing device and includes a fixing roll 30 having a small heat capacity, a pressurizing belt 31, and a pressurizing pad 32.

The fixing roll 30 is structured by coating a surface of a core 30*a* with a resilient layer 30*b*, and coating a surface of the resilient layer 30*b* with a releasing layer 30*c*. The core 30*a* has a thickness of 1.5 mm, an outer diameter of 25 mm, and a length of 380 mm. The resilient layer 30*b* is made of a silicone rubber having a rubber hardness (JIS-A) of 33°, and has a thickness of 0.5 mm and a length of 320 mm. The releasing layer 30*c* is made of a PFA tube having a thickness of 30 μm. A halogen lamp 33 of 650 W is disposed as a heat source inside the fixing roll 30, and heats an inner portion of the fixing roll 30 such that a surface temperature of the fixing roll 30 becomes a predetermined temperature (which depends on a melting temperature of toner, and is generally 140 to 190° C.).

The pressurizing belt 31 includes a polyimide belt having a thickness of 75 μm, an outer diameter of 30 mm, and a length of 330 mm, and a releasing layer made of a PFA tube having a thickness of 30 μm which is formed on a surface of the polyimide belt. Arranged inside the pressurizing belt 31 is a pressurizing pad 32 for pressing the pressurizing belt 31 against the fixing roll 30 to form a nip. The pressing load applied by the pressurizing pad 32 is 33 Kg, and the width of the nip is 6.5 mm. The pressurizing belt 31 and the pressurizing pad 32 have no heat sources.

A recording paper transport path 11 inside the image forming apparatus 100 is provided to a side surface of the image forming apparatus 100, and extends substantially in a vertical direction. The recording paper transport path 11 extending substantially in a vertical direction allows the recording paper, on which an image has been formed and fixed, to be delivered to an upper portion of the image forming apparatus 100. Therefore, without providing a new recording paper transport path, the recording paper can be placed between an image forming apparatus section and the image reading device 102. Additionally disposed inside the image forming apparatus 100 is a curl correcting device 60 for correcting the curl of the standard-size recording paper 18 that has passed the fixing device 15.

Figure 5:
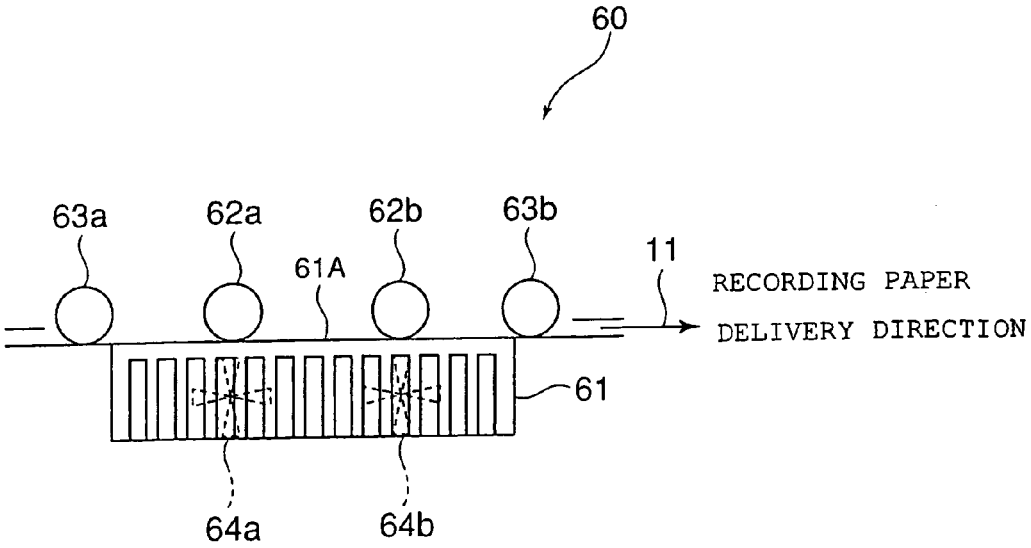
FIG. 5 is a schematic structural diagram showing an example of a curl correcting device.

FIG. 5 is a diagram for explaining the curl correcting device 60. The curl correcting device 60 includes: a heat sink (cooling portion) 61 made of a metal and having a flat region 61A; an upstream side transporting roll 63*a* existing on an upstream side of the heat sink 61 in the transport direction of the recording paper; a downstream side transporting roll 63*b* existing on a downstream side of the heat sink 61 in the transport direction of the recording paper; an upstream side pressing roll (pressing member or curl correcting portion) 62*a* that is opposed to the flat region 61A of the heat sink 61; a downstream side pressing roll (pressing member or curl correcting portion) 62*b* which is opposed to the flat region 61A of the heat sink 61 and exists on a downstream side of the upstream side pressing roll 62*a* in the transport direction of the recording paper; and two blowing fans 64*a* and 64*b*, which emit the heat from the heat sink 61 to indirectly cool the recording paper, and blow air to the recording paper to directly cool the recording paper.

Note that the intervals between the adjacent respective rolls 62*a*, 62*b*, 63*a*, and 63*b* are designed to be shorter than the minimum value of the length of the recording paper in its transport direction. Thus, the recording paper can be transported in a reliable manner.

As described above, the curl correcting device 60 cools the recording paper that has passed the fixing device 15 by the heat sink 61 and the blowing fans 64*a* and 64*b* while retaining the recording paper substantially flat on the flat region 61A. Accordingly, a bend of the recording paper can be prevented, and even after being delivered, the recording paper can be kept substantially flat. In particular, in the case where the roll recording paper 50 is transported as the recording paper, by passing the roll recording paper 50 through the curl correcting device 60, the curl due to a curvature in roll paper diameter can be corrected effectively. In addition, the rotational speed of the downstream side pressing roll 62*b* is set to be higher (by less than 10%, preferably 5% ±3%) than the rotational speed of the upstream side pressing roll 62*a*. Accordingly, the recording paper is stretched, and the curl correction can be performed more effectively.

Note that the recording paper transported on the heat sink 61 is curled with the surface on which the toner image is formed facing outward, and is transported with the outer side of the curl being pressed against the heat sink 61. Also, in the image forming apparatus 100, the recording paper on which the curl remains slightly after the curl correction is curled with the surface on which the toner image is formed facing outward.

EXPERIMENTAL EXAMPLE 1

In order to confirm effects of the curl correction performed in the image forming apparatus 100 according to Embodiment 1, the following experiment was conducted.

First, the experimental conditions are described. The following experimental conditions are employed for the fixing device 15. The fixing temperature is set as 140° C., and the image to be fixed is a toner image of Y, M, C, and K (density: 30%).

Further, as for the roll recording paper feeding cassette 57, the following experimental conditions are employed. That is, as for the pre-correction rolls 52, a sponge roll of ϕ30 mm (20° Asker C) is adopted as one of the rolls around which the recording paper is wrapped; a rotary cutter is adopted as the cutting mechanism 54; and a photosensor is adopted as the paper sensor 55. Further, the roll recording paper 50, which is wound into a roll shape, has a maximum diameter of ϕ120 mm, a minimum diameter of ϕ30 mm, and a width of 297 mm. Further, the roll recording paper 50 is a resin coated paper obtained by coating a base paper of 150 μm in thickness with a polyester resin having a thickness of 15 μm as an image receiving layer.

Further, the experimental conditions for the curl correcting device 60 was set such that the length of the heat sink 61 in the transport direction was 350 mm, axial fans having an air flow rate of 0.4 $m^3$/min is adopted as the blowing fans 64*a* and 64*b*, and the recording paper is cooled down to 70° C. The adopted pressing rolls 62*a* and 62*b* are each made of an EPDM and have a roll diameter of ϕ20 mm. The rotational speed of the downstream side pressing roll 62*b* is set to be higher than the rotational speed of the upstream side pressing roll 62*a* by approximately 5%. The interval between the two rolls is set to 80 mm (see FIG. 5).

Next, experimental method used in Experimental Example 1 will be described. The roll recording paper 50 is sent out by 210 mm by the feeding roll 53 to be cut into the length L of 210 mm, and the roll recording paper 50 having a width of 297 mm and a length of 210 mm is transported by the multiple transporting rolls. At the registration roll 20, a full-color toner image (toner image in the colors of Y, M, C, and K (density: 30%)) is transferred from the secondary transfer roll 12 onto the roll recording paper 50 at a predetermined timing, and is fixed to the roll recording paper 50 by the fixing device 15. Here, for comparison, one sample is delivered from the image forming apparatus 100 without being transported to the curl correcting device 60. Another sample is transported to the curl correcting device 60 in order to confirm the effects of the image forming apparatus 100 according to Embodiment 1. In the curl correcting device 60, the roll recording paper 50 is stretched between the two pressing rolls 62*a* and 62*b* while being retained flat, and is brought into close contact with the flat region 61A of the heat sink 61 serving as the cooling unit by the pressing rolls 62*a* and 62*b* to be cooled down. Note that the roll recording paper 50 is transported at a speed of 60 mm/s, and the transporting speed of the downstream side pressing roll 62*b* is set at 63 mm/s which is higher than the transporting speed of the upstream side pressing roll 62*a*.

Figure 6:
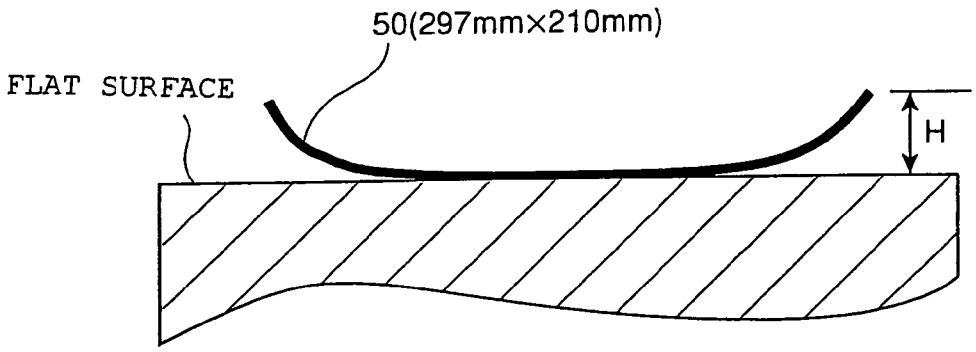
FIG. 6 is a diagram for explaining a curl amount.

Subsequently, a curl amount is measured when the roll recording paper 50 is peeled off after being cooled at the heat sink 61. Here, as shown in FIG. 6, the curl amount measured in this experimental example is determined as follows. That is, the roll recording paper 50 (size: 297 mm in width×210 mm in length) delivered from the image forming apparatus 100 is laid in a level place for approximately 30 minutes, and the maximum value among heights H of four corners of the roll recording paper 50 is obtained as the curl amount thereof. Note that as the measurement conditions, the diameter of the roll recording paper 50 received in the roll recording paper feeding cassette 57 is changed in decrements of 10 mm from 120 mm to 40 mm, and ten sheets of the roll recording paper 50 are printed for each roll paper diameter, and of the respective curl amounts of the printed ten sheets of the roll recording paper 50, the maximum value is set as the curl amount.

Figure 7:
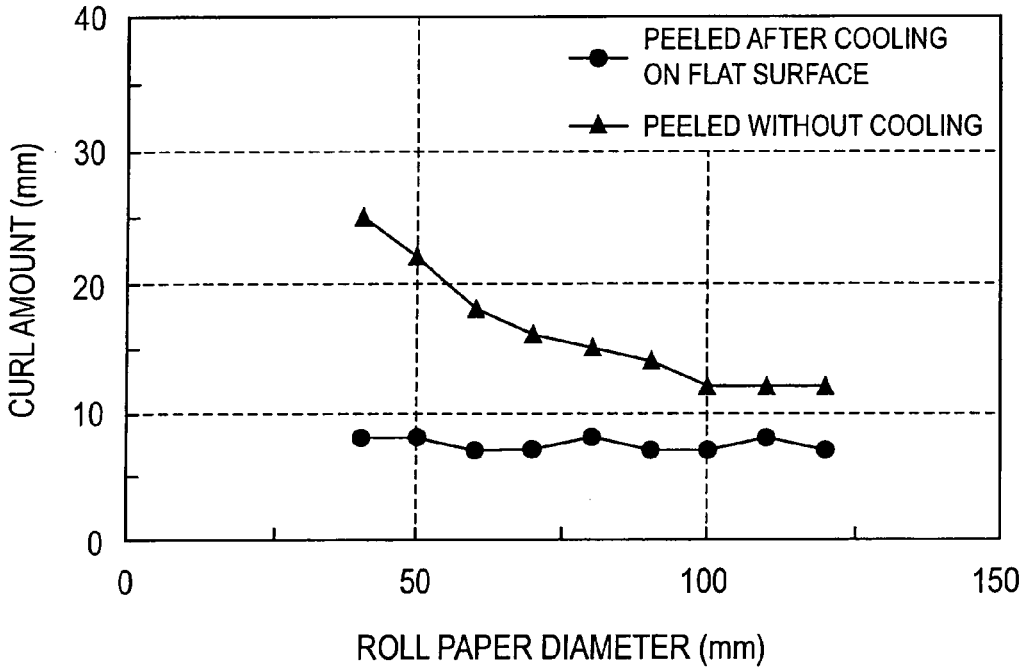
FIG. 7 is a graph showing experimental results of Experimental Example 1.

Next, the experimental results will be described. FIG. 7 is a graph showing the experimental results. The horizontal axis indicates the diameter [mm] of the roll recording paper 50 received in the roll recording paper feeding cassette 57, and the vertical axis indicates the curl amount [mm]. From the results, the curl amounts obtained from the sample for comparison are generally large, and the curl amounts vary within 15 mm and 30 mm depending on the roll paper diameter. On the other hand, in the case where the roll recording paper 50 was cooled down while being retained flat in the image forming apparatus 100 according to this embodiment, the curl amount was 10 mm or less regardless of the roll paper diameter, thereby enabling satisfactory curl correction.

Embodiment 2

Figure 8:
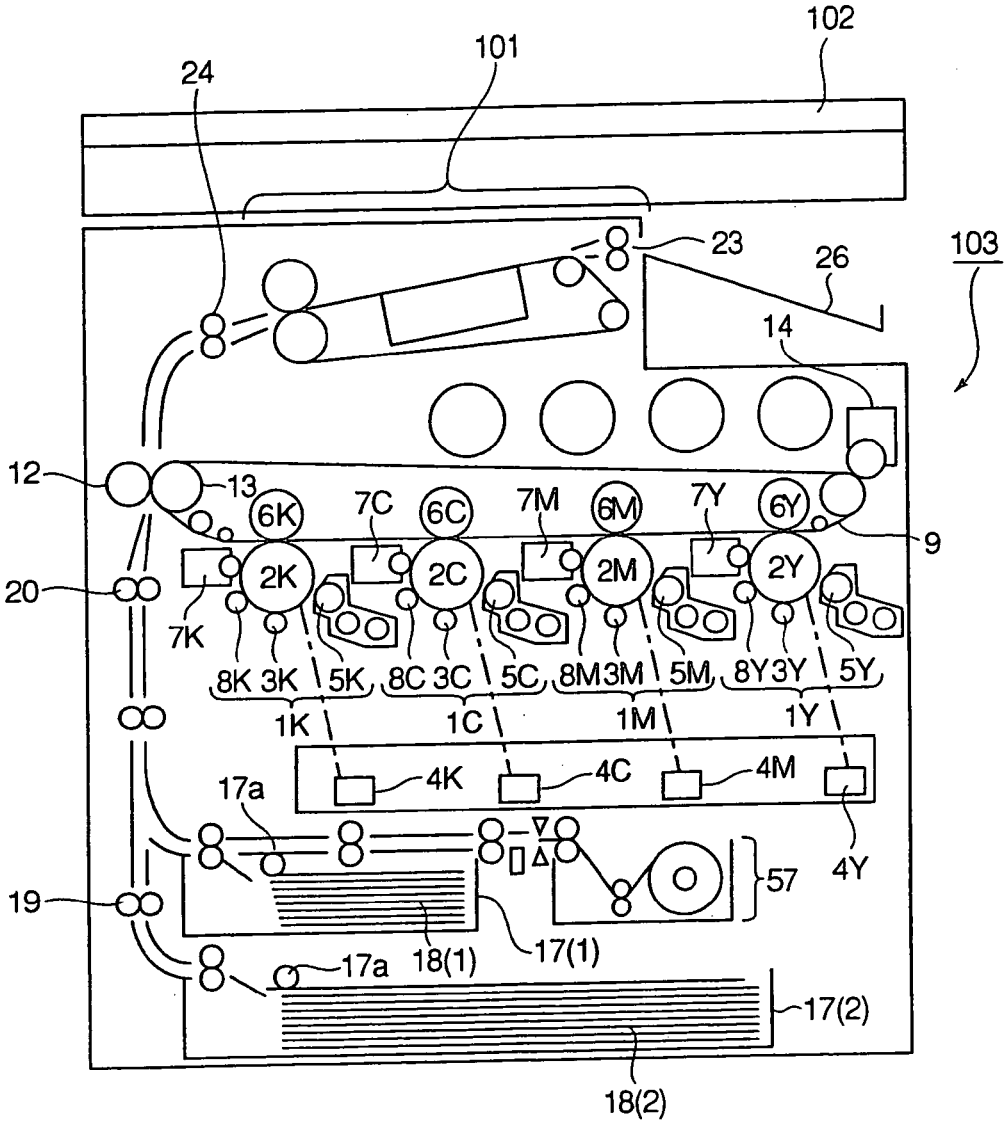
FIG. 8 is a schematic structural diagram showing an image forming apparatus according to Embodiment 2 of the present invention.

FIG. 8 is a schematic structural diagram of a tandem-type color image forming apparatus 103 according to Embodiment 2 of the present invention. In the image forming apparatus 103, the fixing device 15 is removed from the image forming apparatus 100, and a belt fixing device 101 is disposed in place of the curl correcting device 60. In the image forming apparatus 103, the belt fixing device 101 is disposed between the image forming device section and the image reading device 102, and is integrally formed with the image forming device section as shown in FIG. 8. Note that the same structural components as those of the image forming apparatus 100 are denoted by the same symbols, and their description is omitted.

Figure 9:
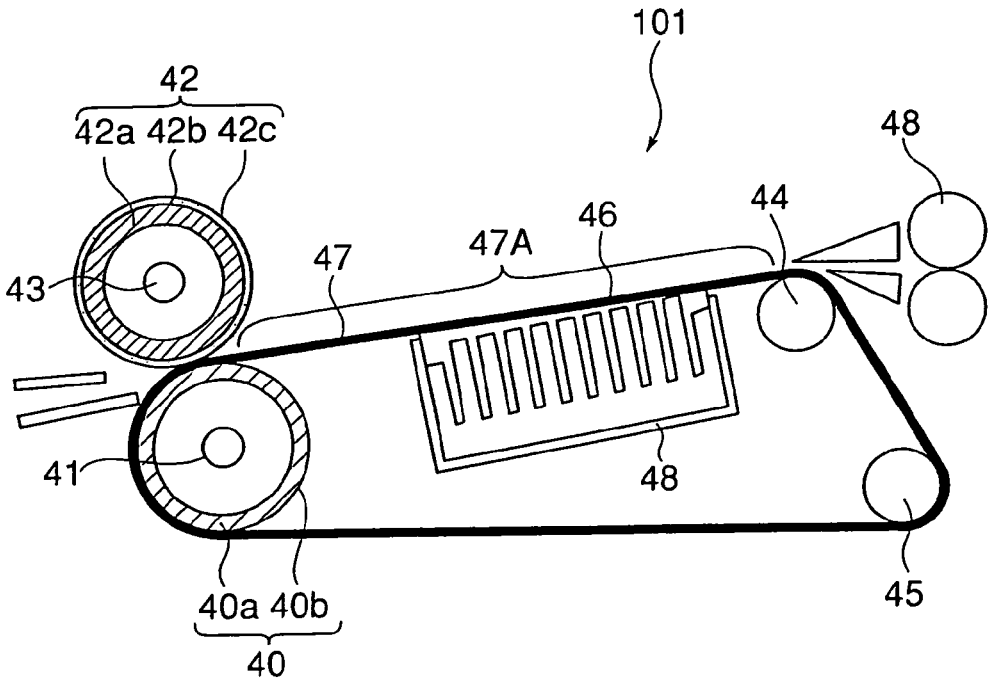
FIG. 9 is a schematic structural diagram showing a belt fixing device.

FIG. 9 is a diagram for explaining the structure of the belt fixing device 101. The belt fixing device 11 includes: a heat-fixing roll 40 having a heat source; a peeling roll (tension roll) 44; a steering roll (tension roll) 45; a fixing belt (endless fixing belt) 47 wound around the heat-fixing roll 40, the peeling roll 44, and the steering roll 45; a pressurizing roll 42 that is pressed against the heat-fixing roll 40 through the fixing belt 47 to form a nip; and a heat sink 46 for cooling a flat region 47A of the fixing belt 47 on a downstream side of the nip in the rotational direction of the fixing belt 47. In the belt fixing device 101, the recording paper carrying toner is transported to a nip portion such that the toner image contacts the fixing belt 47 and is heated and pressurized to be fixed on the recording paper. Then, after the fixing belt 47 and the recording paper are cooled down at the heat sink 46, the recording paper is peeled off from the fixing belt 47.

The heat-fixing roll 40 includes a core 40*a* that is made of a metal high in thermal conductivity, and a releasing layer 40*b* that is made of a fluororesin layer such as a PFA tube and formed on the surface of the core 40*a*. A heat source 41 such as a halogen lamp is included inside the core 40*a* and heats the heat-fixing roll 40 such that its surface temperature becomes a predetermined temperature, thereby heating the fixing belt 47 and the recording paper on which the toner image has been formed. The pressurizing roll 42 is structured by coating a periphery of a core 42*a* with a resilient layer 42*b*, and forming a surface of the resilient layer 42*b* with a releasing layer 42*c*. The core 42*a* is made of a metal high in thermal conductivity. The resilient layer 42*b* is made of a silicone rubber having a rubber hardness (JIS-A) of approximately 40° or the like material. The releasing layer 42*c* is made of a fluororesin layer such as a PFA tube. A heat source 43 such as a halogen lamp is included inside the core 42*a* and heats the pressurizing roll 42 such that its surface temperature becomes a predetermined temperature, thereby making it possible to heat the recording paper from its reverse side while applying pressure to the recording paper at the time of image fixing.

Note that the structures of the heat-fixing roll 40 and the pressurizing roll 42 are not limited to those described above as long as the toner image formed on the roll recording paper 50 can be fixed thereto by means of the fixing belt 47.

The peeling roll 44 operates on a principle that the recording paper is peeled off from the fixing belt 47 by the rigidity of the recording paper itself. The outer diameter configuration (dimensions) of the peeling roll 44 are determined by an adhesive force between the fixing belt 47 and the recording paper, and by a winding angle of the fixing belt 47 around the peeling roll 44. The steering roll 45 serves to prevent damage on belt end portions due to deviation caused by the rotation of the fixing belt 47. By having its axis fixed and the other axis inclined with respect to the heat-fixing roll 40 by a not-shown driving device, in the case where the fixing belt 47 is deviated, the steering roll 45 plays a role of changing an advancing direction of the belt into the reverse direction.

The heat sink 46 serves to cool the recording paper that is in close contact with the flat region 47A of the fixing belt 47. The heat sink 46 is disposed on a downstream side of the heat-fixing roll 40 and on an upstream side of the peeling roll 44, and contacts an inner peripheral surface of the fixing belt 47 to absorb the heat of the fixing belt 47 (indirectly the heat of the recording paper). As will be described later, the heat sink 46 cools a toner image T and a transparent resin layer (image receiving layer) 50*a* on the surface of the roll recording paper 50 which are melted by the heat-fixing roll 40 and the pressurizing roll 42, and causes the entire image surface to coagulate in a smooth state in conformity with the surface of the fixing belt 47, thereby correcting the curl due to the curvature in roll paper diameter and enabling printing with a high gloss. Note that the heat sink 46 is surrounded by a duct 48, and an air flow is formed in the duct 48 by a not-shown blowing fan.

The fixing belt 47 is formed by coating a surface of an endless film made of thermoset polyimide with a silicone rubber layer having a smooth surface and a thickness of 35 μm or the like. From the viewpoint of power consumption, a thin belt is desirable. However, it is preferable to use a polyimide base material having a thickness of 75 μm or more from the viewpoint of strength, and a silicone rubber layer having a thickness of 30 μm or more from the viewpoint that the silicone rubber layer is to be brought into close contact with the toner image T on the recording paper for fixing the toner image T. Further, the fixing belt 47 is stretched around the heat-fixing roll 40, the peeling roll 44, and the steering roll 45, and is driven by the rotation of the heat-fixing roll 40.

Figure 10A:
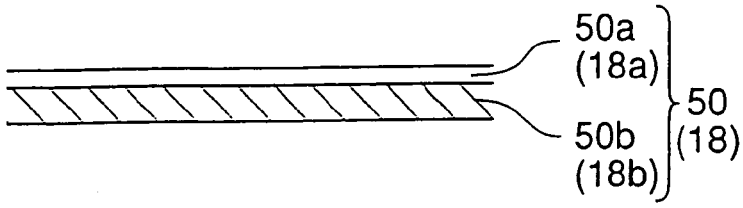
FIGS. 10(*a*) and 10(*b*) are diagrams showing recording sheets each having a resin layer.
Figure 10B:
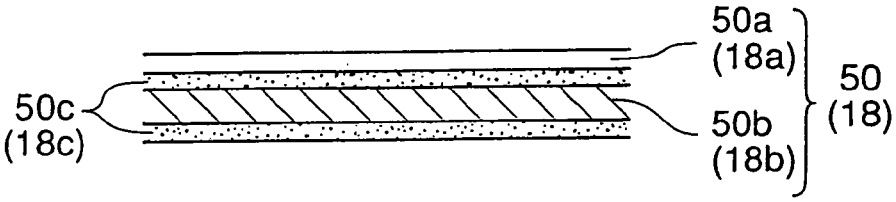

FIGS. 10(*a*) and 10(*b*) are diagrams for explaining a structure of the roll recording paper 50 received in the recording paper feeding cassette 57 of the image forming apparatus 100. In FIG. 10(*a*), a resin coated paper is shown as an example of the roll recording paper 50. The resin coated paper is formed by coating one side (surface) of a base material 50*b* paper made of pulp or the like with a transparent image receiving layer (transparent resin layer) 50*a* containing as its main component a thermoplastic resin made of polyester or the like and having a thickness in a range of 5 to 20 μm, for example, 10 μm. The use of this type of recording paper allows a uniform gloss to develop over the entire paper surface.

As shown in FIG. 10(*b*) as another example of the roll recording paper 50, both surfaces (or only one side surface) of the base material 50*b* made of pulp or the like is coated with a polyolefin resin coated layer 50*c* made of polyethylene, polypropylene, polyethylene terephthalate, polystyrene, or the like, and the base material 50*b* provided with the resin coated layer 50*c* is further coated with the image receiving layer 50*a* for bearing a toner image. The polyolefin resin coated layer 50*c* has a thickness of 10 to 30 μm, and the image receiving layer 50*a* for bearing the toner image T contains as its main component a thermoplastic resin made of polyester or the like and has a thickness in a range of 5 to 20 μm for coating the base material 50*b*. For example, by using a recording paper provided with a transparent image receiving layer (transparent resin layer) 18*a* coated with the receiving layer 50*a* made of a thermoplastic resin and having a thickness of 10 μm, a uniform gloss can be obtained over the entire paper surface. Note that the above-mentioned resin coated papers are adopted as the roll recording papers 50 here, but those resin coated papers, instead of a plain paper, can also be adopted as the standard-size recording paper 18.

Figure 11:
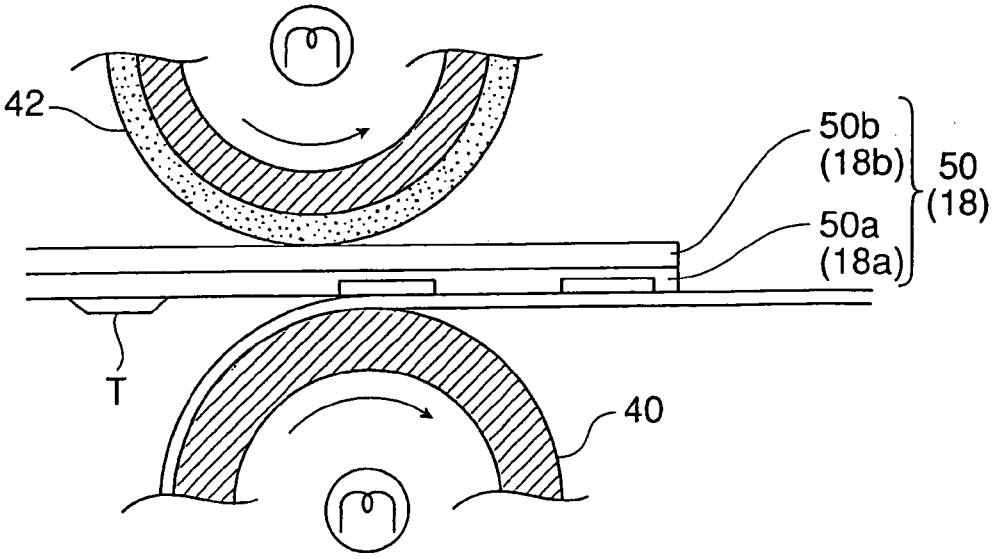
FIG. 11 is a diagram for explaining an operation of the belt fixing device.

FIG. 11 is a diagram for explaining a state where the belt-type fixing device 101 fixes and cools the roll recording paper 50 that bears the toner image T on the image receiving layer 50*a*. With the toner image T born on the image receiving layer 50*a* side of the roll recording paper 50, the roll recording paper 50 is inserted into the nip portion between the heat-fixing roll 40 (fixing belt 47) and the pressurizing roll 42. In the nip portion, the toner image T is embedded into the image receiving layer 50*a* that has been softened due to the action of heat and pressure. The embedded toner image T is transported while being in close contact with the fixing belt 47 having a smooth surface, and cooled down by the heat sink 46 sufficiently (to such an extent that the image receiving layer 50*a* is hardened). Therefore, the toner image T is fixed to an inside of the image receiving layer 50*a*, and the image receiving layer 50*a* provides an extremely smooth and glossy image. After that, the roll recording paper 50 is peeled off from the fixing belt 47 at the peeling roll 44 portion, and delivered onto a delivery tray 26 by a delivery roll 48 with a surface formed with the image facing downward.

As described above, the roll recording paper 50 is brought into close contact with the fixing belt 47 and cooled, whereby it becomes possible to sufficiently cool a recording paper end portion where the cooling is not sufficiently performed by the pressing rolls 62*a* and 62*b* of Embodiment 1. Thus, the curl correction can be performed more satisfactorily. In addition, in the case of using the recording paper as shown in FIG. 10(*a*) or 10(*b*) which is formed by coating the recording paper surface with a resin having heat-melting property, the adhesion of the recording paper with respect to the fixing belt 47 is further enhanced, enabling more effective curl correction.

EXPERIMENTAL EXAMPLE 2

In order to confirm effects of the curl correction performed in the image forming apparatus 103 according to Embodiment 2, the following experiment was conducted.

First, the experimental conditions are described. The following experimental conditions are employed for the belt fixing device 101. That is, an aluminum hard roll of ϕ50 mm is adopted as the heating roll 40; a resilient roll (2 mm rubber layer) of ϕ50 mm is adopted as the pressurizing roll 42; an angle θ between the direction in which the recording paper 50 is delivered from the nip and the fixing belt 47 is 0 degrees (the angle θ is 0±10 degrees, preferably 0±5 degrees), in order to improve the adhesion between the recording paper and the fixing belt 47 after passage of the recording paper through the nip between the heating roll 40 and the pressurizing roll 42; the fixing temperature is set as the heating roll: 125° C./the pressurizing roll: 125° C. (@resin coated paper) and the heating roll: 140° C./the pressurizing roll: 140° C. (@plain paper); as the fixing belt 47, one having a silicone rubber of 35 μm provided on a polyimide base material of t75 μm is adopted; and the image to be fixed is a toner image of Y, M, C, and K (density: 30%). Further, air is blown to the duct 48 having the heat sink 46 (length in the processing direction: 350 mm) in its interior by means of an axial fan (air flow rate: 0.4 $m^3$/min). Then, the recording paper is cooled so that the temperature thereof becomes 70° C. (@resin coated paper) or 80° C. (@plain paper).

As for the roll recording paper feeding cassette 57, the following experimental conditions are employed. That is, as for the pre-correction rolls 52, a sponge roll of ϕ30 mm (20° Asker C) is adopted as one of the rolls around which the recording paper is wound; a rotary cutter is adopted as the cutting mechanism 54; and a photosensor is adopted as the paper sensor 55. Further, the roll recording paper 50, which is wound into a roll shape, has a maximum diameter of ϕ120 mm, a minimum diameter of ϕ30 mm, and a width of 297 mm. Further, the roll recording paper 50 is a resin coated paper obtained by coating a base paper of 150 μm in thickness with a polyester resin having a thickness of 15 μm as an image receiving layer. On the other hand, the standard-size recording paper 18 is a plain paper.

Next, the experimental method is described. As the recording paper, the roll recording paper 50 that is a plain paper and the roll recording paper 50 that is a resin coated paper are used. The roll recording paper 50 is sent out by 210 mm by the feeding roll 53 and then cut (L=210 mm), to be transported by means of multiple transporting rolls as a cut paper of 297 mm in width and 210 mm in length. At the registration roll 20, a full color toner image (toner image of Y, M, C, and K (density: 30%)) is transferred onto the recording paper at a predetermined timing by means of the secondary transferring unit 12.

Here, for comparison, image fixing is effected on one sample (the roll recording paper 50 that may be either a plain paper or a resin coated paper) without subjecting the sample to cooling (by using the belt fixing device 101 with no heat sink 46 installed) The other sample is subjected to image fixing and cooling with the image forming apparatus 103 according to Embodiment 2.

Figure 12:
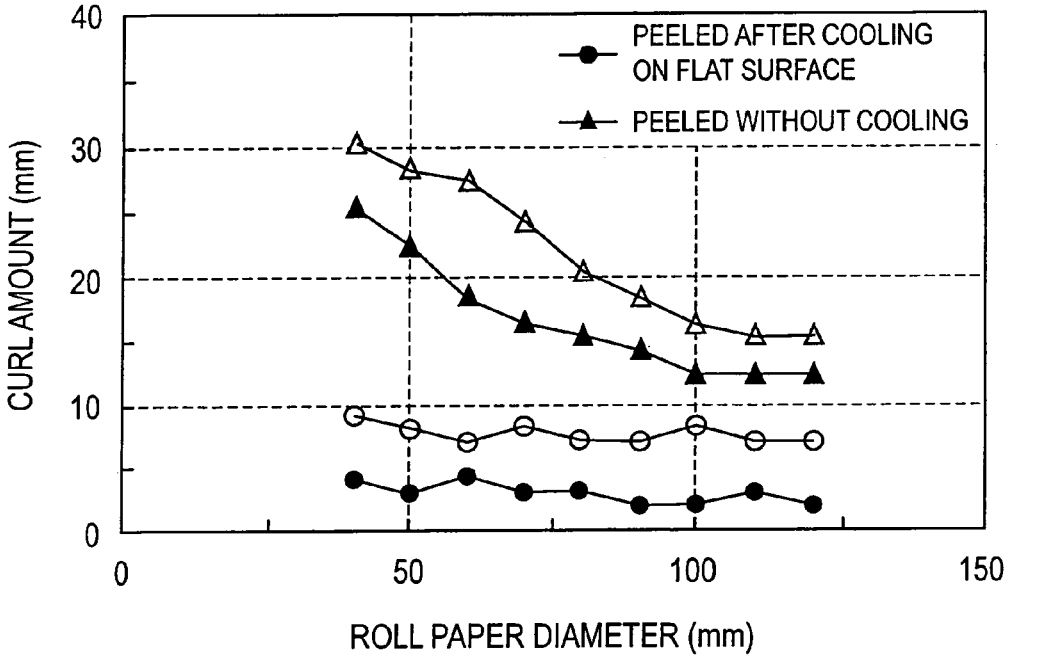
FIG. 12 is a graph showing experimental results of Experimental Example 2.

Next, the experimental results are described. FIG. 12 is a graph illustrating the experimental results. The horizontal axis represents the diameter [mm] of the roll recording paper 50 received in the roll recording paper feeding cassette 57, and the vertical axis represents the curl amount [mm]. As can be seen from the graph, in the case where the roll recording paper 50 is cooled while being retained flat, the curl amount is 5 mm or less irrespective of the roll paper diameter when a resin coated paper is used, enabling curl correction to be performed in a favorable manner. Further, even when a plain paper is used, although the results are not quite as good as with the resin coated paper, toner images on the plain paper are brought into close contact with the fixing belt, and the curl amount is not greater than 10 mm irrespective of the roll paper diameter in the case where the recording paper is subjected to peeling after cooling by the cooling unit, thus providing favorable curl correction.

On the other hand, with the sample under comparison, the curl amount is generally large, and moreover the curl amount varies between 12 mm and 30 mm according to the roll paper diameter. That is, in the case where the recording paper is subjected to peeling without cooling, the curl amount is 12 mm to 25 mm with the resin coated paper and 15 mm to 30 mm with the plain paper, and the curl amount changes according to the roll paper diameter, with the result that the print quality is markedly deteriorated.

Note that as for the measurement conditions, the roll paper diameter is changed in decrements of 10 mm from 120 mm to 40 mm and 10 sheets of paper are printed for each roll paper diameter. Of the amounts of curl observed with the printed 10 sheets of paper, one with the maximum value is plotted as the curl amount (see FIG. 6).

Embodiment 3

Figure 13:
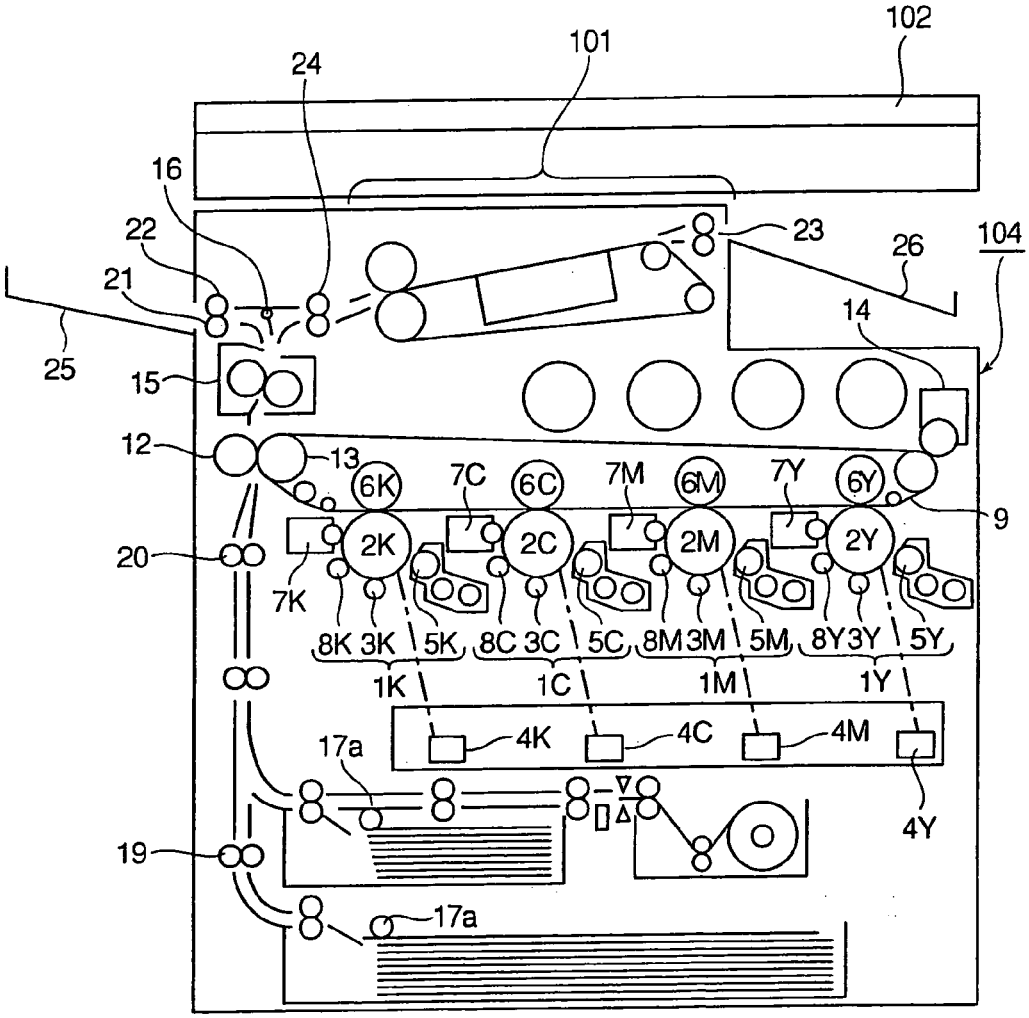
FIG. 13 is a schematic structural diagram showing an image forming apparatus according to Embodiment 3 of the present invention.

FIG. 13 is a schematic diagram showing the construction of a tandem type color image forming apparatus 104 according to Embodiment 3 of the present invention. The image forming apparatus 104 is equipped with the same fixing device (first fixing portion) 15 as that used in Embodiment 1 and the same belt fixing device (second fixing portion, cooling portion, and curl correction portion) 101 as that used in Embodiment 2. Further, the image forming apparatus 104 is endowed with a low-gloss-print mode (first print mode) whereby the recording paper having a toner image T transferred thereto is delivered by being passed though only the fixing device 15, and a high-gloss print mode. (second print mode) whereby the recording paper having the toner image T transferred thereto is delivered by being passed though both the fixing device 15 and the belt fixing device 101. Note that the same or like structural components as those of the image forming apparatus 100 according to Embodiment 1 and those of the image forming apparatus 103 according to Embodiment 2 are denoted by the same symbols and a detailed description thereof is omitted.

Figure 14:
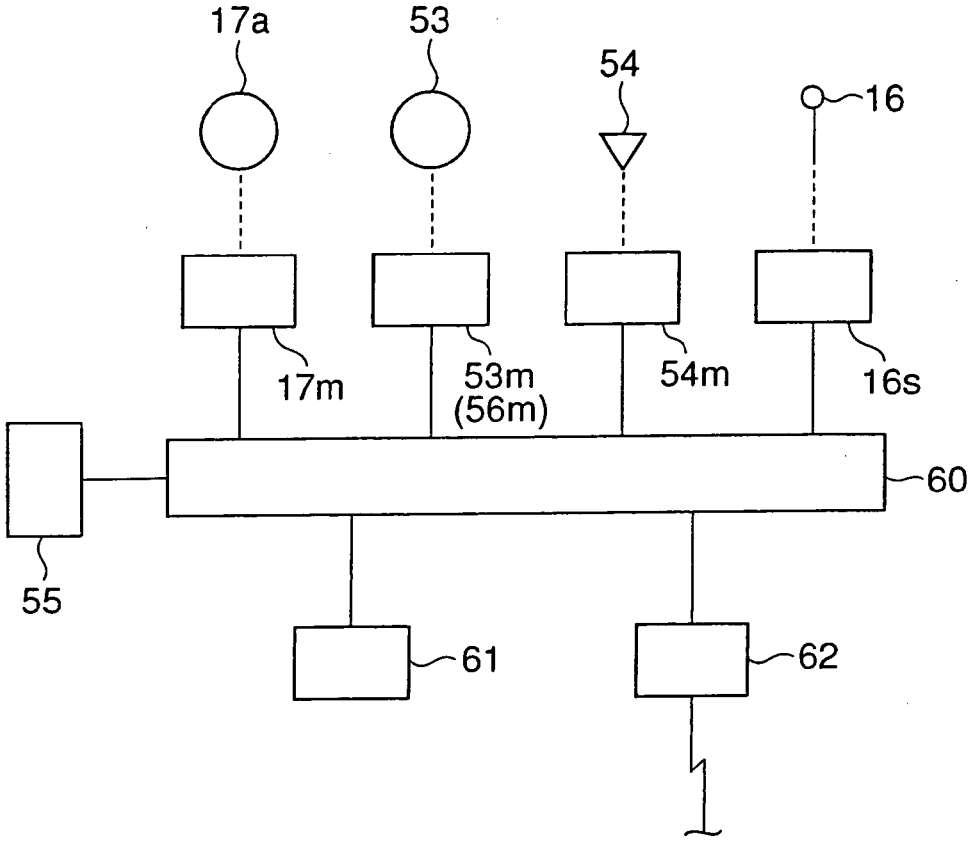
FIG. 14 is a block diagram for explaining a recording paper selecting system and a transport path selecting system.

FIG. 14 is a block diagram for explaining how selection of paper is effected in the image forming apparatus 104 according to this embodiment and a paper path selection control system employed in the same. The construction of the control system is centered on the control (selection) portion 60. Subject to measurement by the control portion 60 are a presence/absence signal indicating the presence/absence of the roll recording paper 50 which is transmitted from a paper sensor 55, a paper designating signal transmitted from a user interface 61 of the image forming apparatus 104 such as a liquid crystal touch panel or an operation button, and an image formation instructing signal transmitted through the intermediation of an information communication control portion 62 from a not-shown personal computer or the like. Further, the control portion 60 performs control on the following: power supply to the feeding roll motor 17*m* that drives the feeding roll 17*a;* power supply to the feeding roll motor 53*m* that drives the feeding roll 53; power supply to a cutting motor (or cutting solenoid) 54*m* that drives the cutting mechanism 54; and power supply to a solenoid 16S that drives a switching gate 16.

With the above control system, the selection of paper is effected in the following manner. First, when a mode designating signal or an image formation instructing signal is transmitted to the control portion 60 from a user interface, a personal computer, or the like, the control portion 60 drives and controls respective functional components on the basis of those signals. For instance, when the low-gloss print mode is designated, the control portion 60 supplies power to the feeding roll motor 17*m* corresponding to the standard-size recording paper 18(1) that is a plain paper. Thus, sheets of standard-size recording paper 18(1) are supplied one by one from the standard-size recording paper feeding cassette 17(1).

Further, when the high-gloss print mode is designated, the control portion 60 supplies power to the feeding roll motor 53 corresponding to the feeding roll 53, so that the roll recording paper 50 that is a resin coated paper is transported from the roll receiving portion 51 (see FIGS. 10(*a*) and 10(*b*)). Then, upon determining that the distance from the leading end of the roll recording paper 50 and the cutting mechanism 54 is "L" through computation based on the leading end detection timing with which the paper sensor 55 detects the leading end of the roll recording paper 50, the rotational speed of the feeding roll 53, and the like, the control portion 60 supplies power to the cutting motor (or cutting solenoid) 54*m* to thereby cut the roll recording paper 50. As a result, sheets of the roll recording paper 50 of a desired size are supplied one by one.

The standard-size paper 18, which is a plain paper transported in the low-gloss print mode, and the roll recording paper 50, which is resin coated paper transported in the high-gloss print mode, each have a full color toner image T transferred thereto by the secondary transferring unit and fixed thereon by the fixing device 15.

Further, with the above-described control system, the selection of the paper path is performed as follows. When the low-gloss print mode is designated, the control portion 60 controls power supply to the solenoid 16S and drives the switching gate 16. The transport path for the recording paper (in this embodiment, the standard-size recording paper 18 that is a plain paper) is switched toward the first recording paper delivery outlet 21 side so that the recording paper is delivered by means of a delivery roll 22 onto a low-gloss mode delivery tray 25 with its image formation surface facing upward. On the other hand, when the high-gloss print mode is designated, the control portion 60 controls power supply to the solenoid 16S and drives the switching gate 16. The transport path for the recording paper (in this embodiment, the roll recording paper 50 that is a resin coated paper) is switched toward the belt fixing device 101 side so that the recording paper is subjected to image formation in the belt fixing device 101 to be delivered onto a high-gloss mode delivery tray 26 with its image formation surface facing downward.

The reason why the recording paper is passed through the belt fixing device 101 again after passing through the fixing device 15 in the high-loss print mode is because much curl correction cannot be expected. That is, with the fixing machine 15 alone, the recording paper is cooled before being cooled in a flat state, with the result that sufficient curl correcting effect cannot be attained (approximately 20 mm as compared with the target value of 10 mm or below) even when the recording paper is cooled in a flat region after passing through the fixing device 15. Therefore, it is necessary to pass the recording paper through the belt fixing device 101 after it passes through the fixing device 15 so that the recording paper is forcibly cooled (by means of the heat sink) before it is naturally cooled. In addition, the recording paper is transported to the heat sink 46 in a state in which the resin layer 50*c* of the resin coated paper and the heat-melting resin layer 50*a* on its surface are melted, and then peeled off by cooling, whereby the curl of the recording paper is effectively corrected and it is possible to give a high gloss appearance across the entire paper surface.

The toner image T on the roll recording paper 50 transported to the belt fixing device 101 is fixed onto the recording paper once by the fixing unit 15 arranged in the interior of the image forming apparatus 104. Thus, upon the transport-direction switching operation by the switching gate 16, image defects such as an image disturbance are not generated even when the toner T is brought into contact with the transporting/supporting member etc.

Furthermore, the transport path for delivering the recording paper is selected according to the type of the recording paper used, such that the plain paper is delivered onto the low-gloss mode delivery tray 25 after passing through the fixing device 15 whereas the resin coated paper is cooled with the heat sink 46 while being retained substantially flat after passing through the belt fixing device 101 and is then peeled off for delivery onto the high-gloss mode delivery tray 26 after having its curl corrected. As a result, the resin coated paper is always transported to the fixing belt 47 of the belt fixing device 101, thus preventing the fixing belt 47 from being stained with paper powder or the like.

EXPERIMENTAL EXAMPLE 3

In order to confirm effects of the curl correction performed in the image forming apparatus 104 according to Embodiment 3, the following experiment was conducted.

First, the experimental conditions are described. The following experimental conditions are employed for the belt fixing device 101. That is, an aluminum hard roll of ϕ50 mm is adopted as the heating roll 40; a resilient roll (2 mm rubber layer) of ϕ50 mm is adopted as the pressurizing roll 42; the angle θ between the direction in which the recording paper 50 is delivered from the nip portion and the fixing belt 47 is 0 degrees (the angle θ is 0±10 degrees, preferably 0±5 degrees), in order to improve the adhesion between the recording paper and the fixing belt 47 after passage of the recording paper through the nip portion between the heating roll 40 and the pressurizing roll 42; the fixing temperature is set as the heating roll: 125° C./the pressurizing roll: 125° C. (@resin coated paper) and the heating roll: 140° C./the pressurizing roll: 140° C. (@plain paper); as the fixing belt 47, one having a silicone rubber of 35 μm provided on a polyimide base material of t75 μm is adopted; and the image to be fixed is a toner image of Y, M, C, and K (density: 30%). Further, air is blown to the duct 48 having the heat sink 46 (length in the processing direction: 350 mm) in its interior by means of an axial fan (air flow rate: 0.4 $m^3$/min). Then, the recording paper is cooled so that the temperature thereof becomes 70° C. (@resin coated paper)

As for the roll recording paper feeding cassette 57, the following experimental conditions are employed. That is, as for the pre-correction rolls 57, a sponge roll of ϕ30 mm (20° Asker C) is adopted as one of the rolls around which the recording paper is wound; a rotary cutter is adopted as the cutting mechanism 54; and a photosensor is adopted as the paper sensor 55. Further, the roll recording paper 50, which is wound into a roll shape, has a maximum diameter of ϕ120 mm, a minimum diameter of ϕ30 mm, and a width of 297 mm. Further, the roll recording paper is a resin coated paper obtained by coating on a base paper of 150 μm in thickness a polyester resin having a thickness of 15 μm as an image receiving layer.

Next, the experimental method is described. As the recording paper, the roll recording paper 50 that is a resin coated paper is used. The roll recording paper 50 is sent out by 210 mm by the feeding roll 53 and then cut (L=210 mm), to be transported by means of multiple transporting rolls as a cut paper of 297 mm in width and 210 mm in length. At the registration roll 20, a full color toner image (toner image of Y, M, C, and K (density: 30%)) is transferred onto the recording paper at a predetermined timing by means of the secondary transferring unit 12.

Here, for comparison, the low-gloss print mode is selected for one sample (the roll recording paper 50 as a resin coated paper) so that image fixing is effected by using the fixing device 15 alone without cooling. For the other sample (the same resin coated roll recording paper 50), the high-gloss print mode is selected using the image forming apparatus 104 according to Embodiment 3 and image fixing and cooling are performed with the fixing device 15 and the belt fixing device 101. Note that as for the measurement conditions, the roll paper diameter is changed in decrements of 10 mm from 120 mm to 40 mm and 10 sheets of paper are printed for each roll paper diameter. Of the amounts of curl observed with the printed 10 sheets of paper, one with the maximum value is plotted as the curl amount (see FIG. 6).

Figure 15:
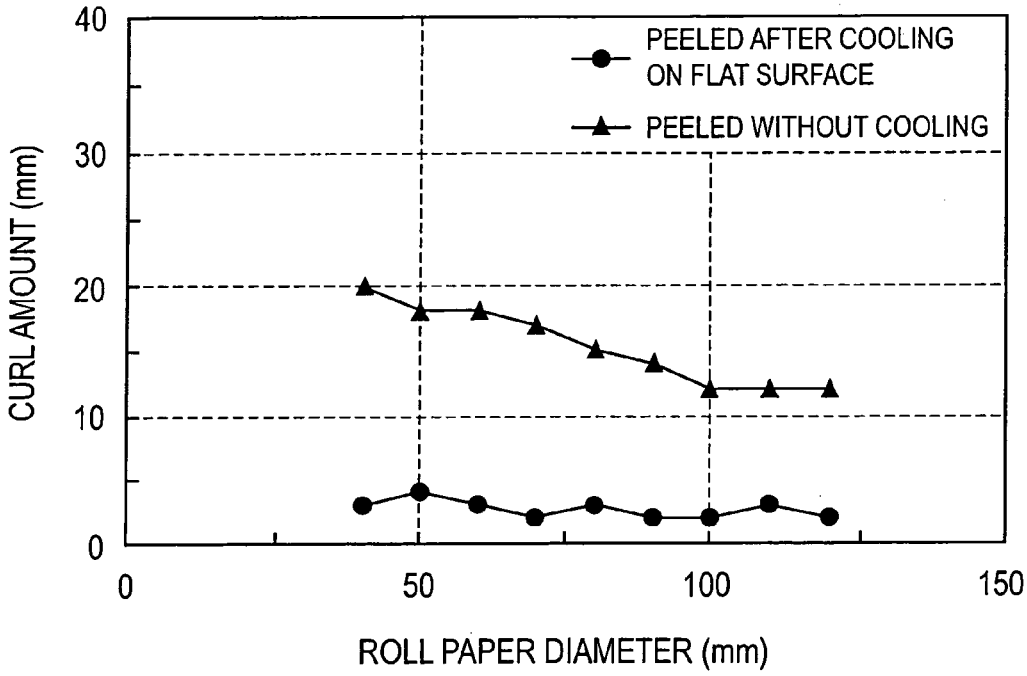
FIG. 15 is a graph showing experimental results of Experimental Example 3.
Figure 16A:
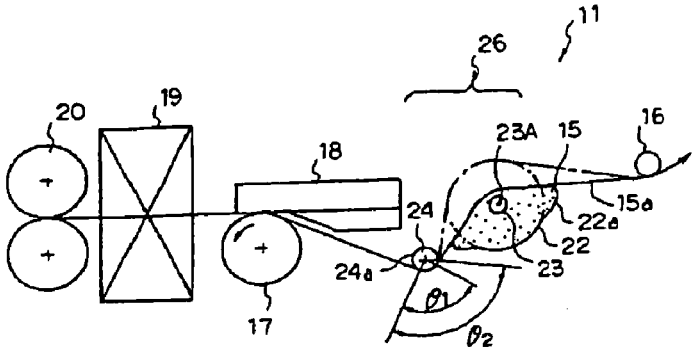
FIGS. 16(*a*) and (*b*) are diagrams showing a conventional curl correcting mechanism.
Figure 16B:
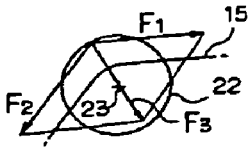

Next, the experimental results are described. FIG. 15 is a graph illustrating the experimental results. The horizontal axis represents the diameter [mm] of the roll recording paper 50 received in the roll recording paper feeding cassette 57, and the vertical axis represents the curl amount [mm]. The resin coated paper exhibits good adhesion with the fixing belt 47 because its surface is covered with the polyester resin 50*a* having heat-melting property. Thus, in the case where the recording paper is peeled off after cooling with the heat sink 46, the curl amount is 5 mm or less irrespective of the roll paper diameter, thereby enabling curl correction to be performed in a favorable manner. On the other hand, in the case where the recording paper is peeled off without cooling, the curl amount is 12 mm to 20 mm, and the curl amount changes according to the roll paper diameter, with the result that the print quality is markedly deteriorated.

As described above, according to the present invention, the following effects can be attained. That is, (1) sufficient curl correction can be performed even when the roll paper is used, making it possible to attain a high print quality; (2) even with a resin coated paper for which fixing temperature cannot be elevated due to generation of blisters, curl can be corrected, making it possible to obtain a high-gloss, high-quality printed image; and (3) the transport path is selected according to the type of the recording paper so that a recording paper having a resin layer is always transported to the belt fixing device, and thus the fixing belt is not stained with paper power, making it possible to obtain a high-gloss, high-quality printed image.

Embodiment 4

Hereinbelow, Embodiment 4 of the present invention is described with reference to the drawings.

Figure 17:
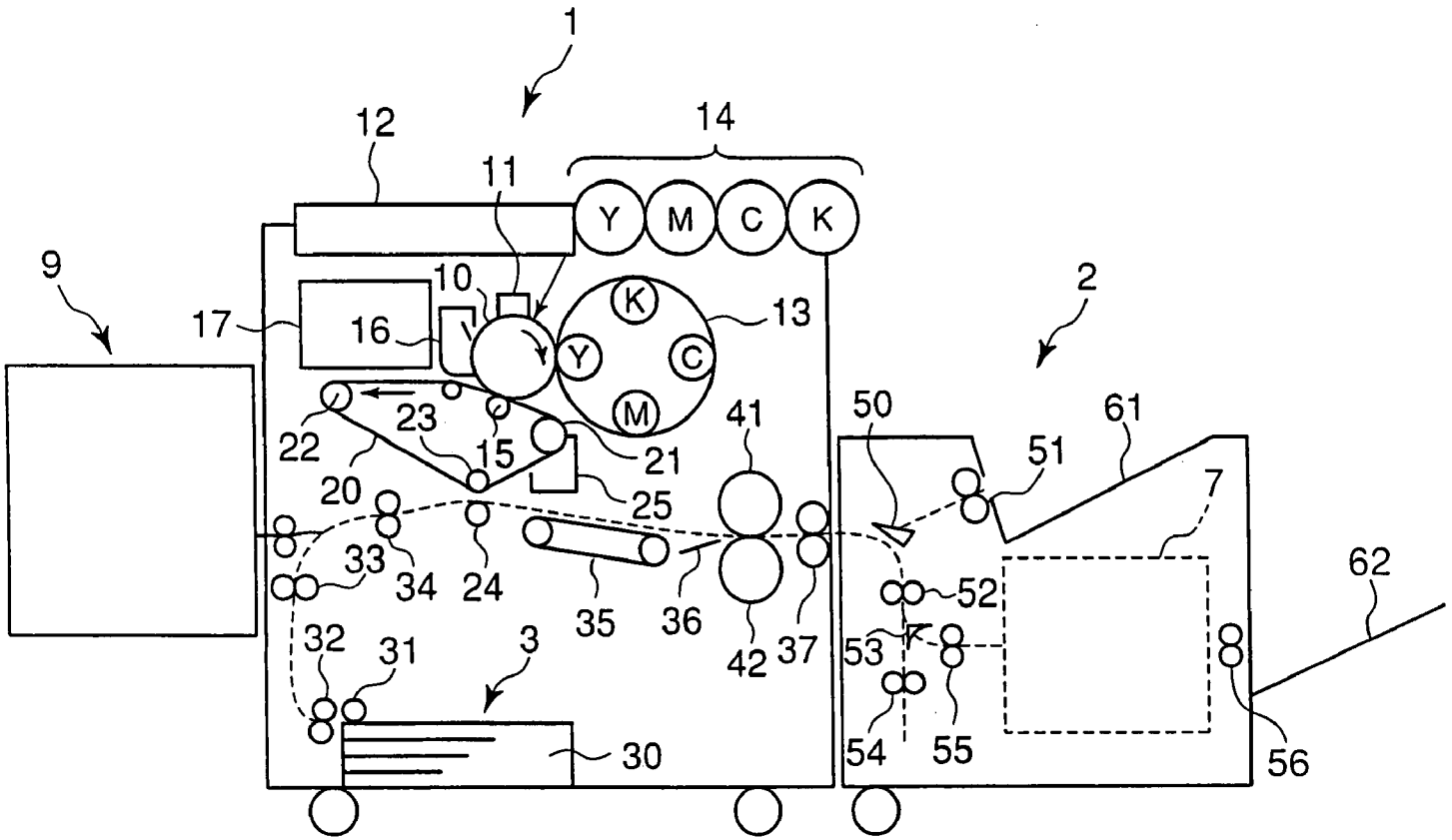
FIG. 17 is a schematic diagram showing an image forming apparatus according to Embodiment 4.

FIG. 17 is across-sectional diagram of an image forming system in which a roll paper unit (roll sheet feeding portion) 9 is mounted to a manual feed unit portion of a conventional image forming apparatus.

The image forming apparatus 1 is roughly constructed of an image forming portion, a secondary transferring portion, a paper transporting portion, and a primary fixing portion. In addition to a photosensitive drum 10, a charging device 11, a photosensitive unit 12, a rotary developing unit 13, a primary transfer roll, and a photosensitive member cleaning unit 16, the image forming portion is also equipped with a toner receiving portion 14 for supplying toner to developing units for respective colors which are provided in the rotary developing unit 13, and a waste toner collecting box 17 for storing waste toner collected by the photosensitive member cleaning unit 16.

The secondary transferring portion includes an intermediate transfer belt 20, a drive steering roll 21, an idle roll 22, a backup roll 23, a secondary transfer roll 24, and a belt cleaning unit 25. The paper transporting portion is equipped with a paper tray 3, a pickup roll 31, a feeding roll pair 32, a transporting roll 33, a registration roll pair 34, a transport belt 35, a paper chute 36, and a delivery roll pair 37. Note that dotted lines in the drawing indicate the transport path for the recording paper. The primary fixing portion includes a heating roll 41 and a pressurizing roll 42.

Used as the toner received in the toner receiving portion 14, the rotary developing unit 13, and the like is toner obtained by dispersing, in an aqueous medium, oil components having a binder resin, a colorant, and a releasing agent dispersed in an organic solvent, and granulating them. The toner contains inorganic fine particles. More specifically, styrene acrylic having an average particle diameter of about 5 μm is used as the binder resin, carnauba wax of about * weight % is used as the releasing agent, and silicon oxide particles having an average particle diameter of 40 nm and of 3 weight % are used as the inorganic fine particles. However, the present invention is not limited to the above.

A secondary fixing unit 2 includes a paper transport portion and a secondary fixing device (smoothing fixing portion) 7. The paper transport portion is equipped with a first movable chute 50, a first delivery roll pair 51, a first delivery tray 61, a transfer roll 52, a second movable chute 53, transporting roll pairs 54 and 55, a second delivery roll 56, and a second delivery tray 62.

The photosensitive drum 10 that is rotated in a direction of the arrow shown in the drawing has its surface uniformly charged by the charging device 11. Then, based on a character signal from a not-shown computer or the like (and by performing image processing i thereon as required), laser light is irradiated to the photosensitive drum 10 surface from the photosensitive unit 12. As a result, a potential difference develops between an exposed portion and a non-exposed portion of the photosensitive drum 10 surface, and an electrostatic latent image is formed due to the potential difference. Then, when the electrostatic latent image formed on the photosensitive drum 10 surface faces the rotary developing unit, a magnetic brush held by a developing roll of a developing device corresponding to yellow is brought into sliding contact with the electrostatic latent image, thereby selectively adhering toner to the portion in which the electrostatic latent image is formed.

In this way, a visualized image developed with yellow toner, that is, a toner image T (Y) is formed on the photosensitive drum 10 surface. When, in accordance with the rotation of the photosensitive drum 10, the toner image T (Y) reaches a position where it faces the primary transfer roll 15, the toner image T (Y) is transferred onto the intermediate transfer belt 20 in an electrostatic manner due to a primary transfer electric field formed by the primary transfer roll 15. The toner image T (Y) thus transferred onto the intermediate transfer belt 20 by the primary transfer is moved in accordance with rotation of the intermediate transfer belt 20 that is rotated in the direction indicated by the arrow in the drawing, to again reach a position where the toner image T (Y) faces the primary transfer roll 15. Note that during this process, the secondary transfer roll 24 and the belt cleaning unit 25 are spaced apart from the intermediate transfer belt 20.

On the other hand, a visualized image-developed with magenta toner, that is, a toner image T (M), is formed on the photosensitive drum 10 in the same manner as described above. Then, at the timing at which the toner image T (Y) that has been already primarily transferred onto the intermediate transfer belt 20 reaches again the position where it faces the primary transfer roll 15, the toner image T (M) on the photosensitive drum 10 also reaches a position where it faces the primary transfer roll 15, and the toner image T (M) are overlapped on the toner image T (Y) formed on the intermediate transfer belt, due to the primary transfer electric field formed by the primary transfer roll 15. Likewise, a toner image T (C) developed with cyan toner and a toner image T (B) developed with black toner are overlapped one after the other, with the result that a full color toner image T (F) is finally formed on the surface of the intermediate transfer belt 20. Note that during this process, the secondary transfer roll 24 and the belt cleaning unit 25 abut against the intermediate transfer belt 20.

Then, sheets of the standard-size recording paper 30 supplied from the standard-size recording paper feeding cassette 3 or roll recording paper 90 supplied from a roll paper unit 9 (described later) while being cut into a desired size, are transported one by one by way of the pickup roll 31, the feeding roll 32, and the transporting roll 33, to be temporarily retained (stopped) in position by the registration roll pair 34. Then, the registration roll pair 34 are rotated in synchronism with the timing at which the toner image T (F) on the intermediate transfer belt 20 faces the secondary transfer roll 24, so that the registration roll pair 34 send the recording paper, which they have retained in position, into a press-contact portion between the secondary transfer roll 24 ad the intermediate transfer belt 20.

Then, the toner image T (F) on the intermediate transfer belt 20 is subjected to secondary transfer onto the recording paper due to a secondary electric field formed by the secondary transfer roll 24. During this process, the toner image T (F) is transferred onto the recording paper. In the case where the recording paper 90 is supplied as the recording paper, the toner image T (F) is subjected to secondary transfer onto an image receiving layer 90*a* of the roll recording paper 90. A slight amount of toner remaining on the intermediate transfer belt 20 surface without being subjected to the secondary transfer is removed by the belt cleaning unit 25.

The recording paper having the toner image T (F) retained on its surface reaches the first fixing portion by way of the transport belt 35 and the paper chute 36. Then, when passing through the press-contact portion between the heating roll 41 and the pressurizing roll 42 that rotate while being in press contact with each other, the toner image T (F) is fixed onto the recording paper as a permanent image under the action of heat and pressure applied by those rolls. The recording paper that has been subjected to this primary fixing process is transported to the exterior of the image forming apparatus 1 by means of the delivery roll pair 37, to be transported into the secondary fixing unit.

One of the transport paths indicated by the dotted lines in the drawing is selected by the movable chute 50 for the recording paper that has been transported into the secondary fixing unit. Thus, the standard-size recording paper 30 transported in the low-gloss mode is delivered onto the low-gloss mode delivery tray 61. The roll recording paper 90, transported in the high-gloss mode, is subjected to image fixing processing (described later) by the secondary fixing device 7 so that the image retained on its surface is imparted with an even higher gloss, and then delivered onto the high-gloss mode delivery tray 62.

Figure 18:
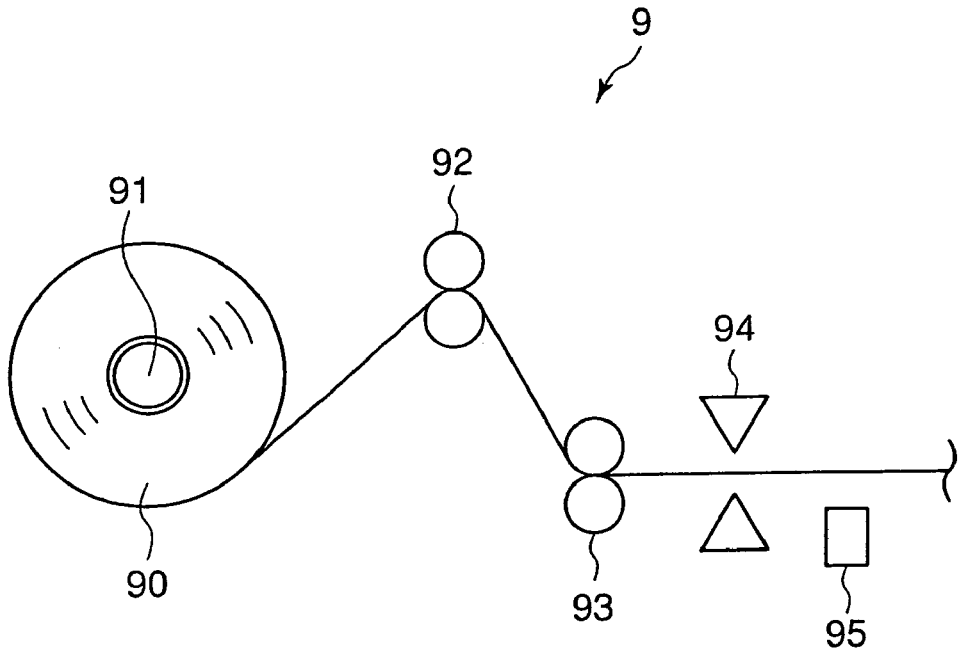
FIG. 18 is a schematic structural diagram showing a roll paper unit.

FIG. 18 illustrates the construction of the roll paper unit 9. As shown in the drawing, the roll paper unit 9 includes the roll recording paper (continuous recording sheet) 90, a roll shaft (roll retaining portion) 91 that rotatably retains the roll recording paper 90, a pre-correction roll 92 that corrects the curl of the roll recording paper 90 in advance, a feeding roll (roll transporting portion) 93 that transports the leading end of the roll recording paper 90, a cutting mechanism (cutting portion) 94 that cuts the roll recording paper 90 into a desired size, and a paper sensor 95 that is provided on the transport path of the roll recording paper 90 and detects the presence/absence of the roll recording paper 90.

Figure 19A:
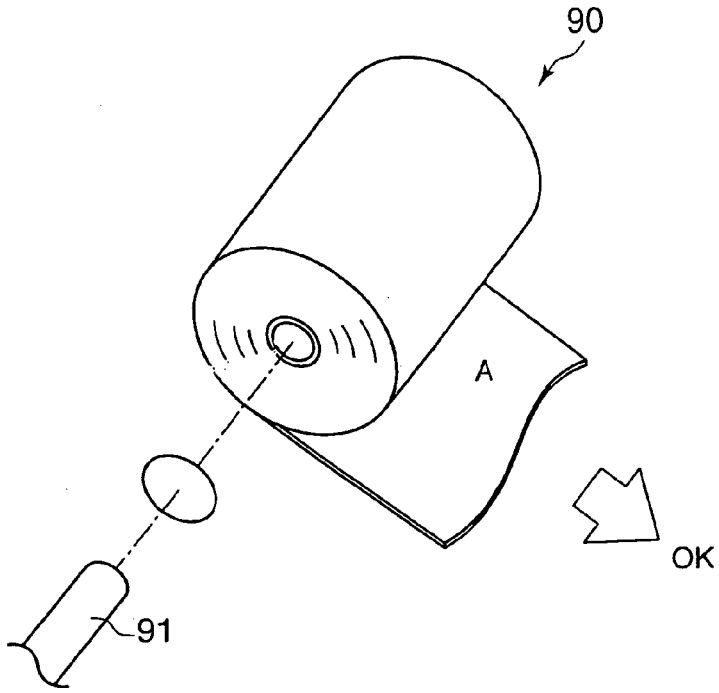
FIGS. 19(*a*) and 19(*b*) are diagrams for explaining how a roll paper is attached.
Figure 19B:
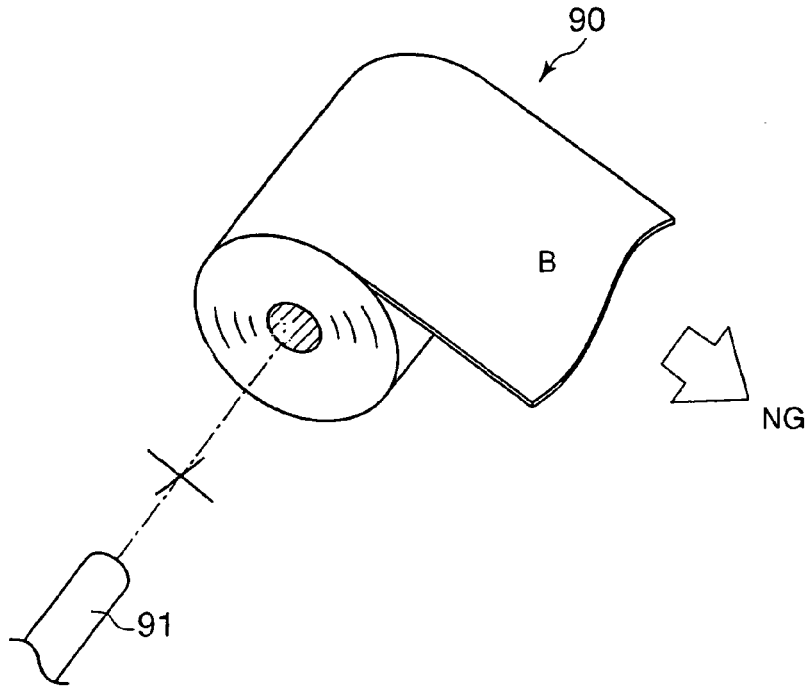

FIGS. 19(*a*) and 19(*b*) illustrate mounting and dismounting of the roll recording paper 90 to and from the roll shaft 91. At the center of the roll recording paper 90, one side with respect to the roll axis direction is open while the other side is closed. Therefore, the roll recording paper 90 is adapted such that it can be mounted to the roll shaft 91 only from its one side with respect to the roll axis direction. That is, while it is possible to mount the roll recording paper 90 to the roll shaft 91 from the open side of the roll recording paper 90 (see FIG. 19(*a*)), it is impossible to mount the roll recording paper 90 to the roll shaft 90 from the closed side of the roll recording paper 90 (see FIG. 19(*b*)). As a result, a front surface A and a reverse surface B of the roll recording paper 90 to be transported are not mistaken one for the other.

Figure 20A:
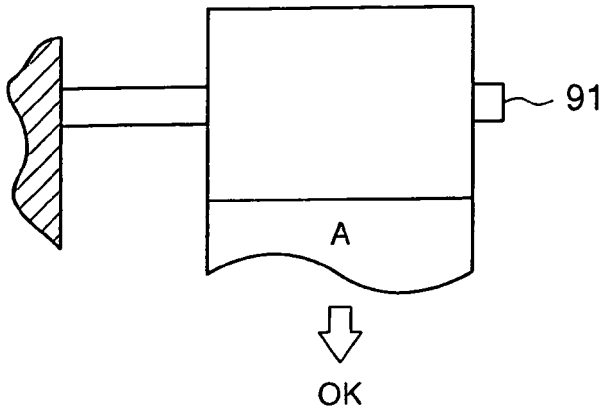
FIGS. 20(*a*) and 20(*b*) are diagrams for explaining how the roll paper is attached.
Figure 20B:
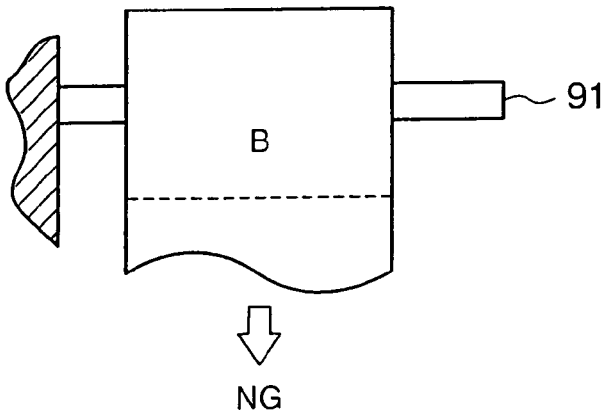

The erroneous mounting of the roll recording paper 90 can be also prevented by displacing the attachment position of the roll recording paper 90 with respect to the axial direction of the roll shaft 91 according to the attachment direction of the roll recording paper 90 (see FIGS. 20(*a*) and 20(*b*)).

Figure 21A:
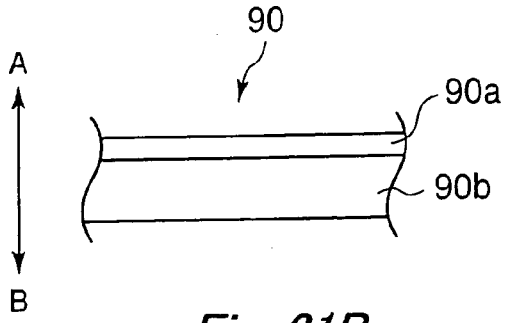
FIGS. 21(*a*) and 21(*b*) are diagrams for explaining sectional structures of roll papers.
Figure 21B:
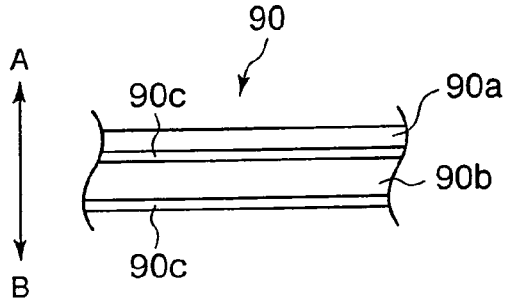

FIGS. 21(*a*) and 21(*b*) illustrate the cross-sectional structure of the roll recording paper 90. As one example of the roll recording paper 90, shown in FIG. 21(*a*) is a resin coated paper including a base material 90*b* made of pulp or the like and the transparent image receiving layer (transparent resin layer) 90*a* which is mainly composed of a thermoplastic resin made of polyester and coated on one side (front surface A) of the base material 90*b* at a thickness in the range of 5 to 20 μm, for example, at a thickness of 10 μm. By using such recording paper, it is possible to obtain a uniform gloss appearance across the entire paper surface.

As shown in FIG. 21(*b*), in another example of the roll recording paper 90, the roll recording paper 90 includes the base material 90*b* made of pulp or the like and polyolefin resin coated layers 90*c* made of polyethylene, polypropylene, polyethylene terephthalate, polystyrene, or the like which are provided on both the front and reverse surfaces (or only on one surface) of the base material, with the receiving layer 90*a* for bearing a toner image thereon being further coated on the front surface A of the base 90*b* where the resin coated layer 90*c* is provided. The polyolefin resin coated layers 90*c* are each coated at a thickness of 10 to 30 μm. The receiving layer 90*a* for bearing the toner image T thereon, which has as its main component a thermoplastic resin made of polyester or the like, is coated at a thickness of 5 to 20 μm. For example, by using the transparent image receiving layer (transparent resin layer) 90*a* obtained by coating a thermoplastic resin at a thickness of 10 μm, it is possible to obtain a uniform gloss appearance across the entire paper surface.

While in this example the base material 90*b* is selected from, for example, a plain paper, a printing coated paper, an art paper, a cast coated paper, etc., the base material 90*b* is not limited to those, and it is also possible to use a synthetic paper, a plastic film, and the like for the base material 90*b*. The basis weight of the base paper (as measured according to JIS P8124) is desirably within the range of 60 to 250 g/m$^2$.

Further, as occasion demands, the receiving layer 90*a* and the base material 90*b* may each contain a matt agent, a lubricant, and/or an antistatic agent in order to adjust the coefficient of friction acting between sheets.

Used as the matt agent are fine particles of silica, starch, alumina, or the like, or plastic powders of polyethylene, polyester, polyacrylonitrile, polymethyl methacrylate, or the like. The amount of the matt agent to be used is preferably within the range of 0.1 to 10 weight %. It is also preferred that the matt agent to be used has an average particle diameter of not larger than 7 μm. The particle diameter and the amount of the matt agent to be used are adjusted such that the surface gloss (as measured according to JIS P8142) of the resin layer becomes 85% or higher.

As the lubricant, higher fatty acid such as stearic acid, metallic salt of higher fatty acid such as zinc stearate, higher fatty acid amide such as stearic acid amide and methylol compound thereof, or carbon hydride such as polyethylene wax, is used. The particle diameter of the lubricant is preferably not larger than 8 μm.

As the antistatic agent, there may be used alkylbenzimidazole sulfonate, naphthalene sulfonate, carboxylic sulfonate, phosphate, hetero cyclic amines, ammonium salts, sulfonium salts, phosphonium salts, betaine-based amphoteric salts, or a metal oxide consisting of ZnO, $SnO_2$, $Al_2O_3$, $In_2O_3$, MgO, BaO, $MoO_3$, $TiO_2$ or the like. The amount of the above-mentioned organic antistatic agent to be used is appropriately set within the range of 0.1 to 10 wt % with respect to the resin, and the amount of the above-mentioned metal-oxide antistatic agent to be used is appropriately set within the range of 0.05 to 10 wt %.

Note that in this embodiment, the roll recording paper 90 of the latter example (see FIG. 21(*b*) ) is adopted. Therefore, the exterior side of the roll recording paper 90, which is wound into a roll shape, is covered with the reverse surface B, that is, with the polyolefin resin coated layer 90*c*, thus allowing the roll recording paper 90 to exhibit its moisture-proof effect. In addition, the toner image is formed on the image receiving layer (transparent resin layer) 90*a* side (front surface A side) of the roll recording paper 90. Further, the length of the roll recording paper 90 is about 20 m.

Figure 22:
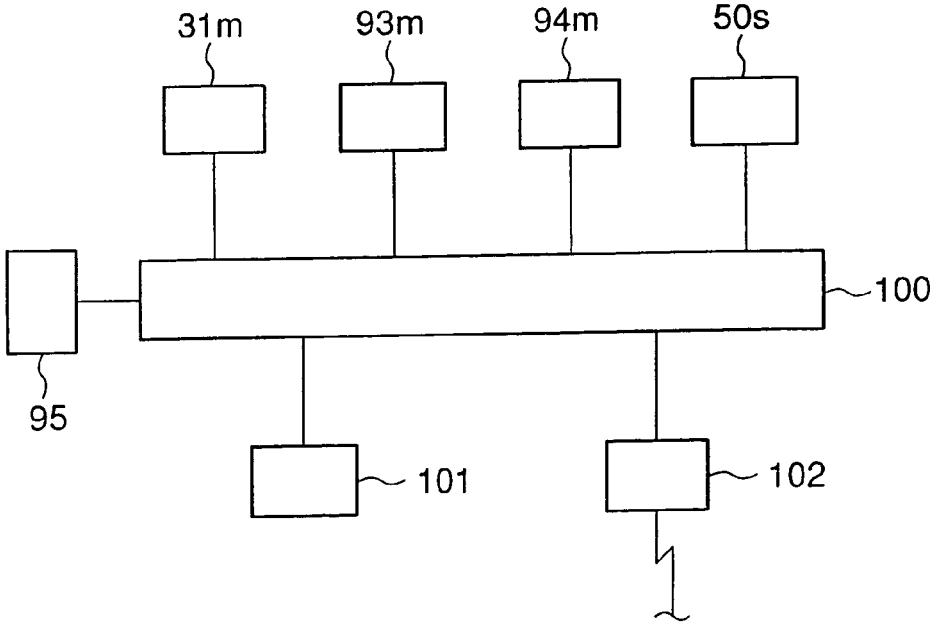
FIG. 22 is a block diagram for explaining a control system.

FIG. 22 is a block diagram for explaining how selection of paper is effected in the image forming system according to this embodiment and a paper path selection control system employed in the same. The construction of the control system is centered on a control (selection) portion 100. Subject to measurement by the control portion 100 are a presence/absence signal indicating the presence/absence of the roll recording paper 90 which is transmitted from the paper sensor 95, a paper designating signal transmitted from a user interface 101 of the image forming system such as a liquid crystal touch panel or an operation button, and an image formation instructing signal transmitted through the intermediation of an information communication control portion 102 from a not-shown personal computer or the like. Further, the control portion 100 performs control on the following: power supply to a feeding roll motor 31*m* that drives the feeding roll 31; power supply to a feeding roll motor 93*m* that drives the feeding roll 93; power supply to a cutting motor (or cutting solenoid) 94*m* that drives the cutting mechanism 94; and power supply to a solenoid 50S that drives the first movable chute 50.

With the above control system, the selection of paper is effected in the following manner. First, when a mode designating signal or an image formation instructing signal is transmitted to the control portion 100 from a user interface 100 such as a liquid crystal touch panel or an operation button, a personal computer, or the like, the control portion 100 drives and controls respective functional components on the basis of those signals. For instance, when the low-gloss print mode is designated, the control portion 100 supplies power to the feeding roll motor 31*m* corresponding to the standard-size recording paper (standard-size recording sheet) 30 that is a plain paper. Thus, sheets of the standard-size recording paper 30 are supplied one by one from the standard-size recording paper feeding cassette (standard-size sheet feeding portion) 3.

Further, when the high-gloss print mode is designated, the control portion 100 supplies power to the feeding roll motor 93*m* corresponding to the feeding roll 93, so that the roll recording paper 90 that is a resin coated paper retained by the roll shaft 91 is transported (see FIG. 18). Then, upon determining that the distance from the leading end of the roll recording paper 90 and the cutting mechanism 94 is "L" through computation based on the leading end detection timing at which the paper sensor 95 detects the leading end of the roll recording paper 90, the rotational speed of the feeding roll 93, and the like, the control portion 100 supplies power to the cutting motor (or cutting solenoid) 94*m* to thereby cut the roll recording paper 90. As a result, sheets of the roll recording paper 90 of a desired size are supplied one by one.

Further, with the above-described control system, the selection of the paper path is performed as follows. When the low-gloss print mode is designated, the control portion 100 controls power supply to a solenoid 50S and drives the first movable chute 50. The transport path for the recording paper (in this embodiment, the standard-size recording paper 30 that is a plain paper) is switched toward the first recording paper delivery outlet 61 side so that the recording paper is delivered by means of the delivery roll 61 onto the low-gloss mode delivery tray 61 with its image formation surface facing upward. On the other hand, when the high-gloss print mode is designated, the control portion 100 controls power supply to the solenoid 50S and drives the first movable chute 50. The transport path for the recording paper (in this embodiment, the roll recording paper 50 that is a resin coated paper) is switched toward the belt fixing device 7 side so that the recording paper is subjected to image fixing in the belt fixing device 7 to be delivered onto the high-gloss mode delivery tray 62 with its image formation surface facing downward.

Note that the roll recording paper 90 having the length L has its curl mitigated to some extent by the action of the pre-correction roll 90. The control portion 100 includes a central processing unit, a storage unit, an input/output unit, and the like. The control portion 100 conducts information communication and processing with other components by way of various information buses and interface devices to realize the control described above.

Figure 23A:
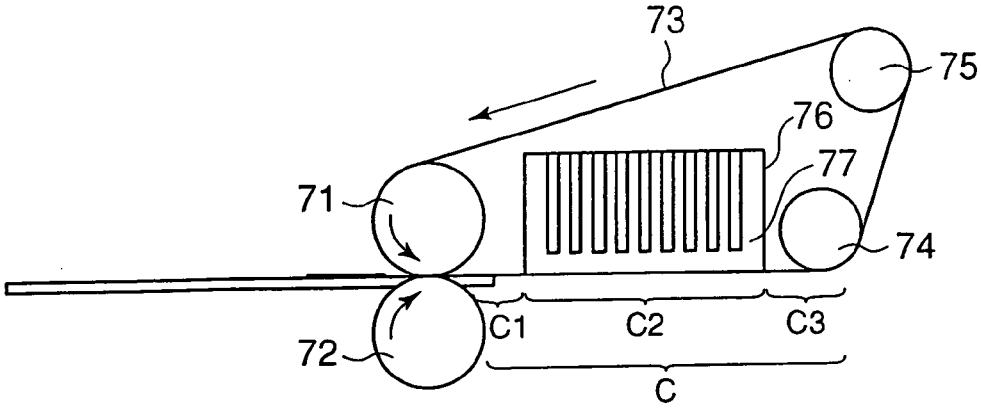
FIGS. 23(*a*) to 23(*c*) are schematic drawings of a belt fixing device.
Figure 23B:
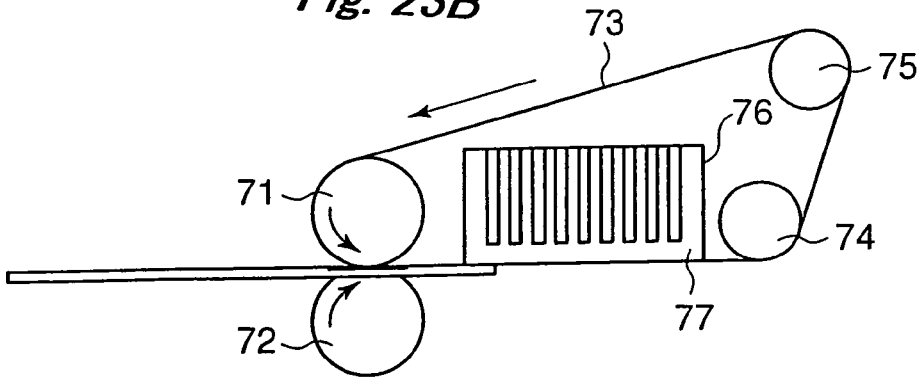
Figure 23C:
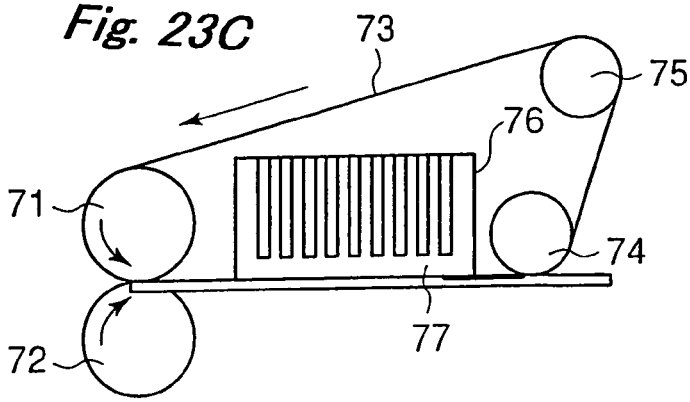

FIGS. 23(*a*) to 23(*c*) illustrate the construction and operation of the belt fixing device (smoothing fixing portion) 7. The belt fixing device 7 includes a heating roll 71 (first fixing roll), a peeling roll 74, a tension roll 75, and a pressurizing roll 72 (second fixing roll) that is brought into press contact with the heating roll 71 in an opposing manner with an endless belt (fixing belt) 73 therebetween, the endless belt 73 being wound around the rolls 71, 74, and 75 and rotating in the direction indicated by the arrow in the drawings. A portion of the endless belt 73 which extends from the pressurizing roll 71 to the peeling roll 74 is arranged in a substantially horizontal direction.

In this example, the heating roll 71 employs a concentric three-layer structure including a core portion, a resilient layer, and a releasing layer. The core portion is made of an aluminum hollow pipe having a diameter of 44 mm and a thickness of 7 mm, the resilient layer is made of silicone rubber having a JIS-A hardness of 40° and a thickness of 3 mm, and the releasing layer is made of PFA having a thickness of 30 μm. Note that a halogen lamp as a heat source is arranged inside the hollow pipe of the core portion. The pressurizing roll 72 has the same construction as described above. The endless belt 73 employs a two-layer structure having a mirror-finished releasing layer on its front surface (surface in abutment with the recording paper and the pressurizing roll 72) and a base material on its reverse surface (surface in abutment with the pressurizing roll 71). This releasing layer is made of a silicone rubber layer having a thickness of 30 μm, and the base material is made of thermoplastic polyimide having a thickness of 80 μm.

Among the heating roll 71, the peeling roll 74, and the tension roll 75, the heating roll 71 has the largest diameter. The heating roll 71, the peeling roll 74, and the tension roll 75 are positioned such that the wrap angle of the endless belt 73 with respect to the heating roll 71 is larger than the wrap angle of the endless belt 73 with respect to the peeling roll 74.

In a region from the heating roll 71 to the peeling roll 74 situated downstream with respect to the rotation direction of the endless belt 73, a heat sink 77 is provided so as to abut against the reverse surface of the endless belt 73. An air duct 76 is provided so as to surround the heat sink 77, with a not-shown fan provided in one end of the air duct 76. An air flow perpendicular to the plane of the drawing is generated by the fan within the air duct 76. In addition, a pressing roll pair 78 are arranged across the heat sink 77 to achieve more efficient heat transmission through the belt.

A predetermined tension is imparted to the endless belt 73 by the tension roll 75, and the heating roll 71 is rotated in the direction indicated by the arrow in the drawing, causing the endless belt 73 to rotate. Electric power is supplied to the halogen lamp arranged in each of the heating roll 71 and the pressurizing roll 72, causing the temperatures of the respective surfaces of the heating roll 71 and the pressurizing roll 72 to rise.

After the toner image T (F) is transferred onto the roll recording paper 90 (and after the primary fixing is performed), as shown in FIG. 23(*a*), the roll recording paper 90 passes through a press-contact portion N between the heating roll 71 (endless belt 73) and the pressurizing roll 72. During this process, the temperature of the image receiving layer 90*a* rises due to the heat from the heating roll 71 and the pressurizing roll 72, causing the roll recording paper to soften. Further, as the pressures of the heating roll 71 and the pressurizing roll 72 are applied, the toner image T (F) is embedded in the high-temperature image receiving layer 90*a*. At the same time, the roll recording paper 90 is brought into close contact with the surface of the endless belt 73 (see FIG. 23(*b*).

Subsequently, in accordance with the rotation of the endless belt 73, the roll recording paper 90 is transported to a cooling region C while being in close contact with the endless belt 73. At this time, the recording paper is naturally cooled due to the ambient environment or the like in partial regions c1 and c3 of the cooling region C. On the other hand, in a forced-cooling region c2 surrounded by those partial regions c1 and c3, the recording paper is forcibly cooled with efficiency by the heat sink 77 and by the action of an air flow circulating in the air duct 76.

As described above, the roll recording paper 90 retained in close contact with the surface of the endless belt 73 is sufficiently cooled in the cooling region C. Then, as shown in FIG. 23(*c*), the roll recording paper 90 is peeled off from the endless belt 73 due to its own rigidity in a region where the curvature of the endless belt 73 changes due to the peeling roll 74, that is, in the wrap region of the peeling roll 74.

At the time when it is peeled off from the endless belt 73 surface, the toner image T (F) is embedded in the recording paper (more precisely, the image receiving layer 90*a*) and cooled. Since the recording paper 90 is cooled while being in close contact with the mirror-finished surface of the endless belt 73 in this way, the full color toner image T (F) on the recording paper 90 exhibits an extremely high smoothness, making it possible to obtain a high gloss. At this time, the temperature difference between the image receiving layer 90*a* immediately after passing through the press-contact portion N between the heating roll 71 and the pressurizing roll 72 and the image receiving layer 90*a* immediately after being peeled off from the surface of the endless belt 73, is approximately 70° C.

Embodiment 5

Hereinbelow, Embodiment 5 of the present invention is described with reference to the drawings.

Figure 24:
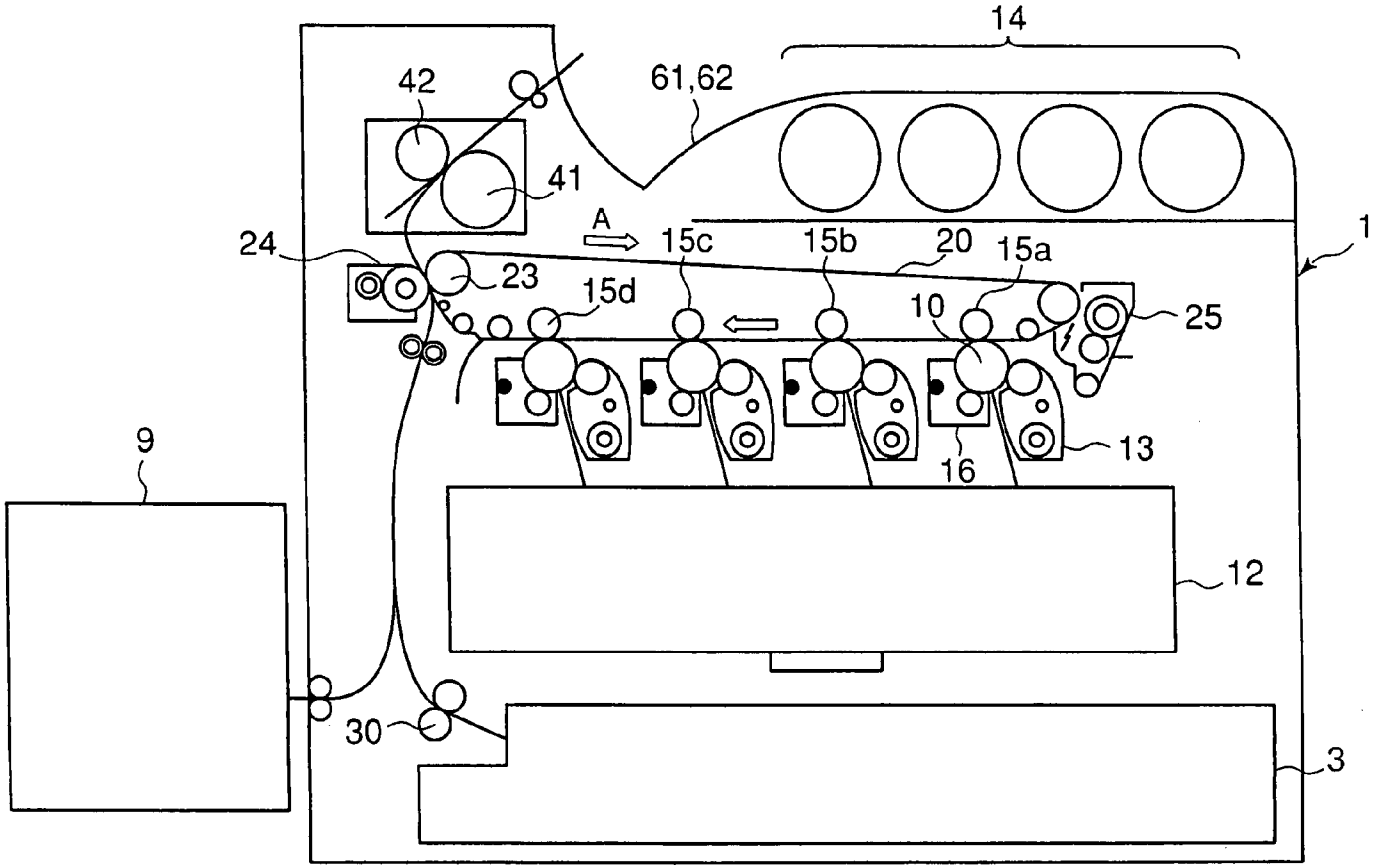
FIG. 24 is a schematic diagram showing an image forming apparatus according to Embodiment 5.

FIG. 24 is across-sectional diagram of an image forming system in which a roll paper unit (roll sheet feeding portion) 9 is mounted to a manual feed unit portion of a conventional image forming apparatus. Note that the same structural components as those of Embodiment 4 are denoted by the same symbols, and a detailed description thereof is omitted.

In the image forming apparatus shown in FIG. 24, four image bearing members 10 are provided in parallel. The image bearing members 10 each have an electrostatic latent image formed thereon upon receiving exposure light irradiated from an exposure device 12. A developing device 13, which is a unit for forming a toner image by visualizing the electrostatic latent image, and a cleaner 16 for removing residual toner are arranged on the outer periphery of each of the image bearing members 10.

Provided above the respective image bearing members 10 is an endless type intermediate transfer belt 20 that circulates and moves in the direction of the arrow A while being in contact with the respective surfaces of the image bearing members. Provided at positions on the reverse surface side of the intermediate transfer belt 20 which correspond to the respective image bearing members 10 are a transfer roll 15*a* located at the most upstream position with respect to the arrow A direction, a transfer roll 15*d* located at the most downstream position, and other transfer rolls 15*b* and 15*c*. Tension rolls that tension the intermediate transfer belt 20 and press it into contact with the respective image bearing members 1 are provided outside both the transfer roll 15*a* and the transfer roll 15*d*.

The standard-size recording paper 30 from a paper case 3 that stores the standard-size recording paper 30, or the roll recording paper 90 from the roll paper unit 9, is selectively transported. In order for a toner image on the intermediate transfer roll 20 to be finally transferred onto the recording paper at a position between the recording paper and the intermediate transfer belt 20 on which the toner image is formed, a secondary transfer roll 24 is provided downstream of the transfer roll 8 with respect to the arrow A direction, and fixing devices 41 and 42 for fixing the toner image transferred onto the recording paper are provided above the secondary transfer roll 24. The intermediate transfer belt 20, having been subjected to the secondary transfer process in this way, circulates and moves in the arrow A direction, and residual toner on the intermediate transfer belt is removed by a cleaner 27 provided upstream of the transfer roll 24.

Further, provided above the intermediate transfer belt 20 are toner boxes 14 each storing toner to supply the toner to the developing device 13 along a not-shown path. The above-mentioned respective devices are covered with a casing. The casing has curved portions 61 and 62 provided in its upper portion, so that sheets of recording paper onto which a toner image has been finally transferred and fixed can be stacked.

In the image forming apparatus constructed as described above, the toner image T (F) formed on the recording paper is fixed onto the recording paper by the ordinary roll fixing devices 41 and 42.

The roll paper unit 9 uses the roll recording paper 90 having a length of about 20 m, a width of 297 mm, and a maximum diameter of ϕ120 mm, which is obtained by coating the base paper 90*b* at a thickness of 150 μm with the resin layer 90*a* at a thickness of 15 μm. At this time, by controlling the timing at which the roll paper is cut with a cutter (see FIG. 24), sheets of two different paper sizes can be obtained from one roll paper (for example, A4; 297×210 mm and A3; 297×420 mm), making it possible to perform image formation by using recording sheets of different sizes in a limited space without providing additional trays. Note that in the roll recording paper 90 in the roll paper unit 9, the image receiving layer 90*a* exists on the outer side (unlike in Embodiment 1).

MODIFIED EXAMPLE 1

Figure 25:
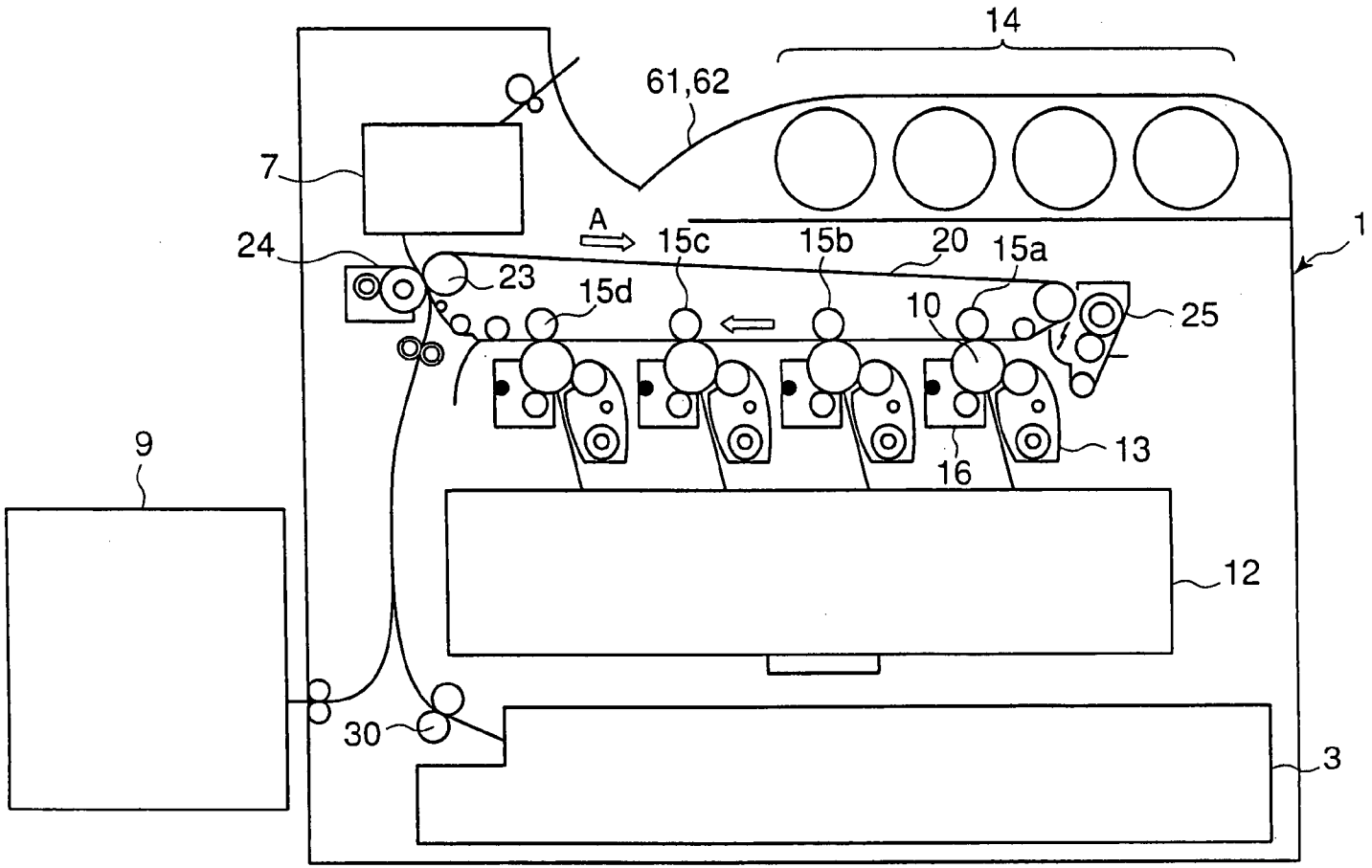
FIG. 25 is a schematic diagram showing an image forming apparatus according to Modified Example 1 of Embodiment 2.

FIG. 25 is a cross-sectional schematic diagram for explaining an image forming apparatus according to Modified Example 1. According to Modified Example 1, the roll fixing devices 41 and 42 of Embodiment 2 are replaced by the belt fixing device 7. As a result, gloss processing can be performed while adopting the basic construction of an existing image forming apparatus.

MODIFIED EXAMPLE 2

Figure 26:
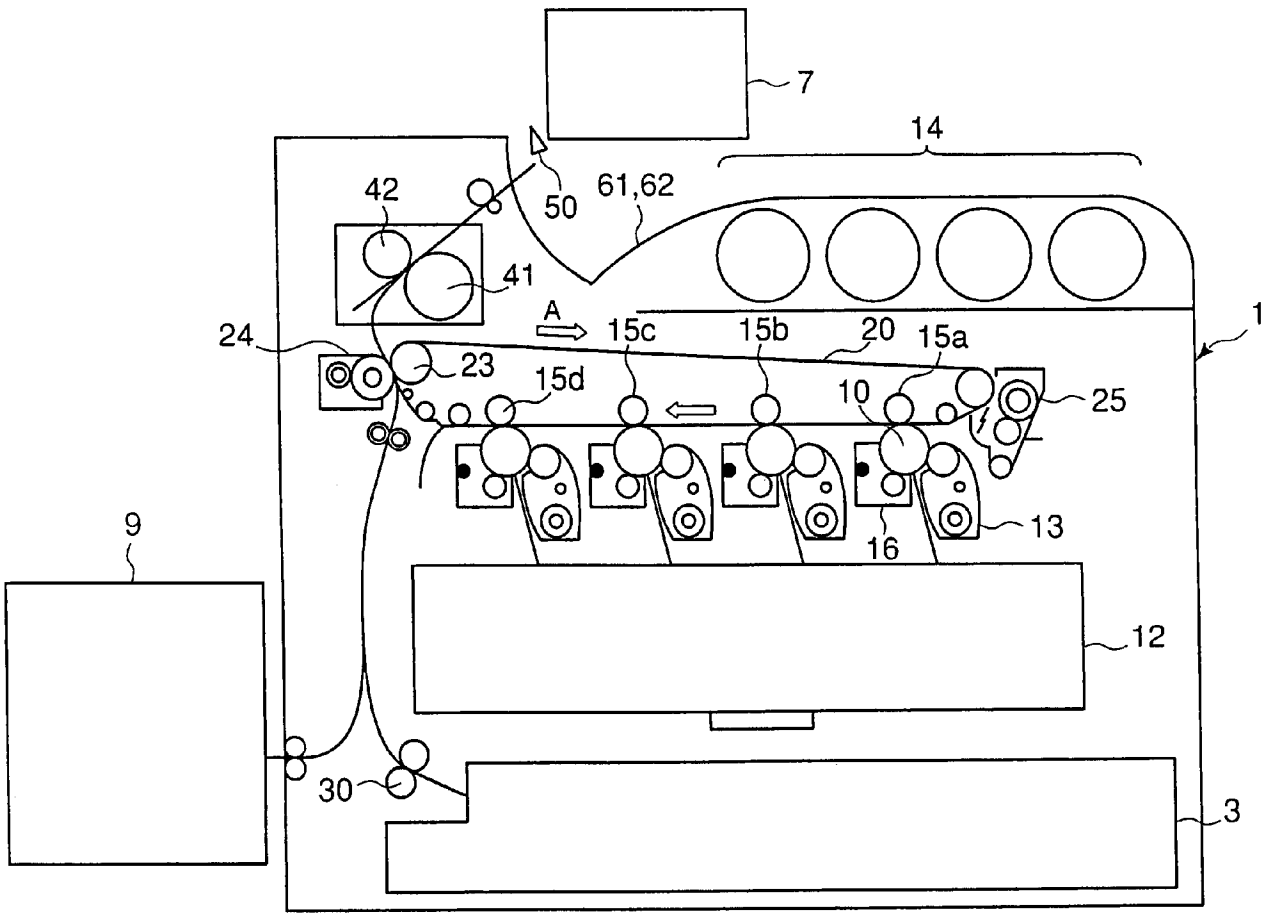
FIG. 26 is a schematic diagram showing an image forming apparatus according to Modified Example 2 of Embodiment 2.

FIG. 26 is a cross-sectional schematic diagram for explaining an image forming apparatus according to Modified Example 2. According to Modified Example 2, the belt fixing device 7 is added to the image forming apparatus of Embodiment 2. As a result, ordinary image fixing and gloss processing can be performed while adopting the basic construction of an existing image forming apparatus. In this case, a control as to whether the gloss processing is performed or not is effected by the operation of the movable chute 50.

MODIFIED EXAMPLE 3

Figure 27:
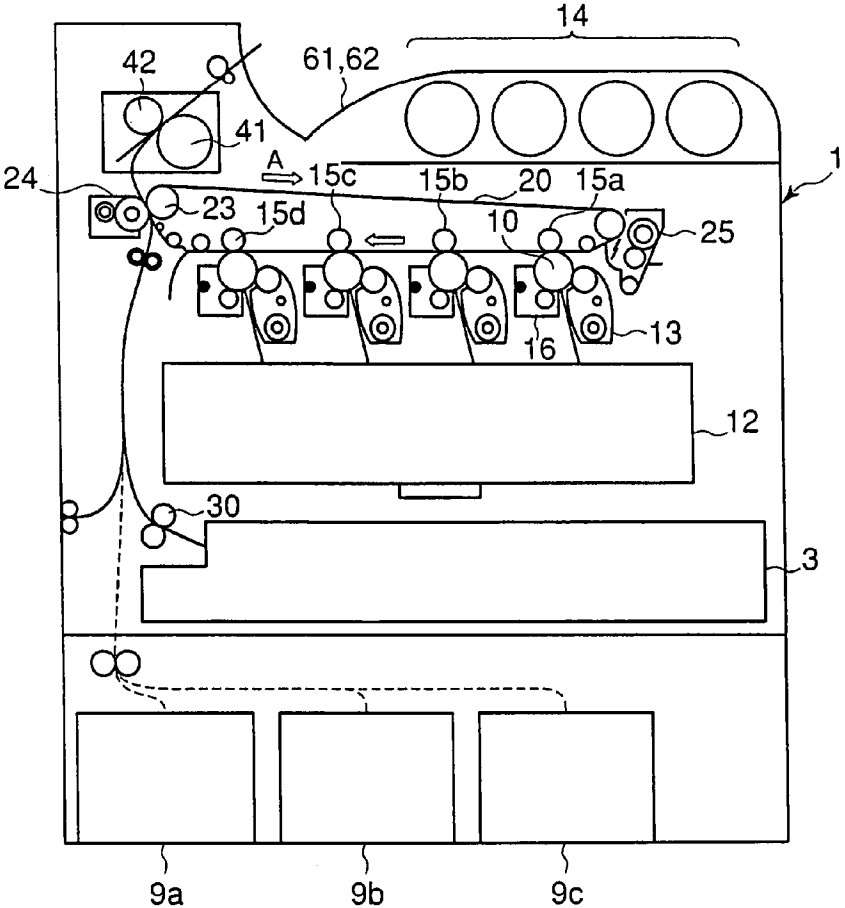
FIG. 27 is a schematic diagram showing an image forming apparatus according to Modified Example 3 of Embodiment 2.
Figure 28A:
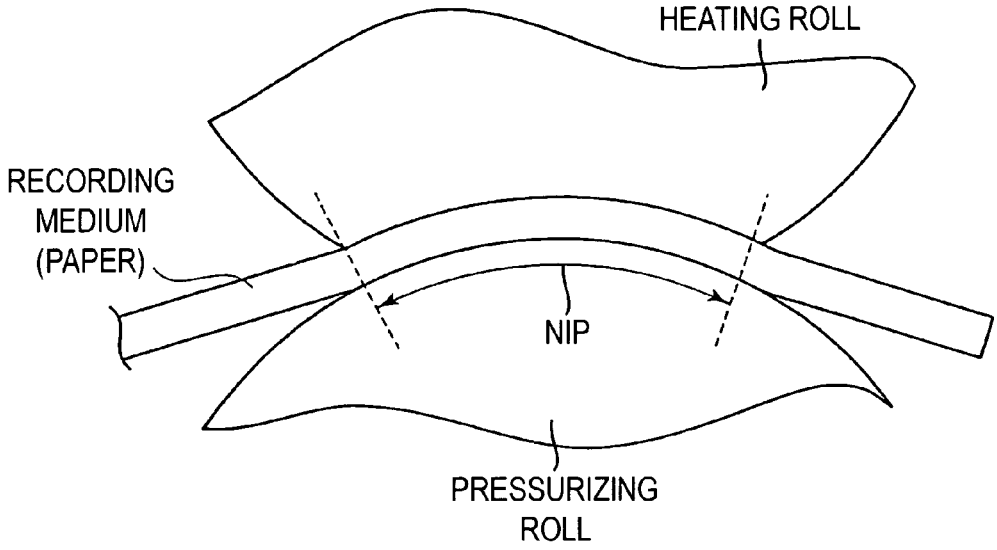
FIGS. 28(*a*) and 28(*b*) are diagrams for explaining a conventional fixing device.
Figure 28B:
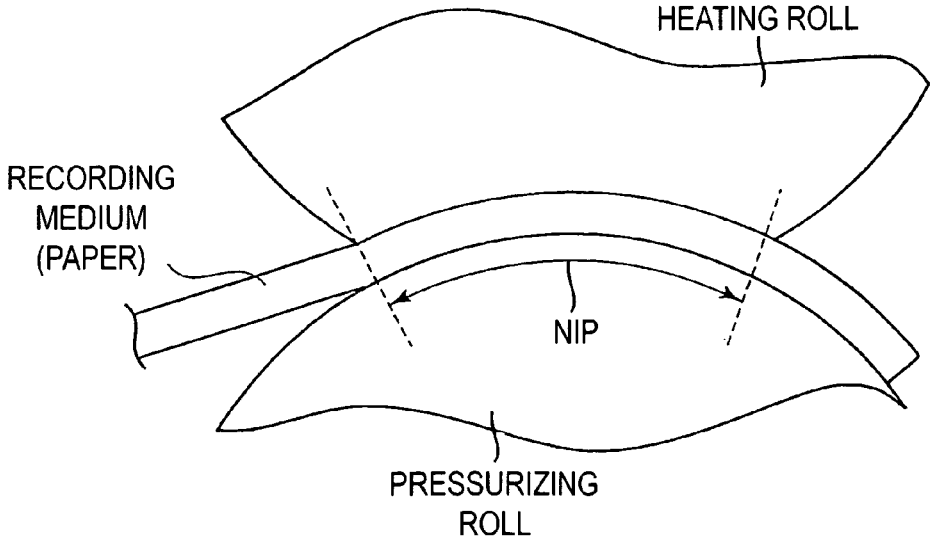
Figure 29:
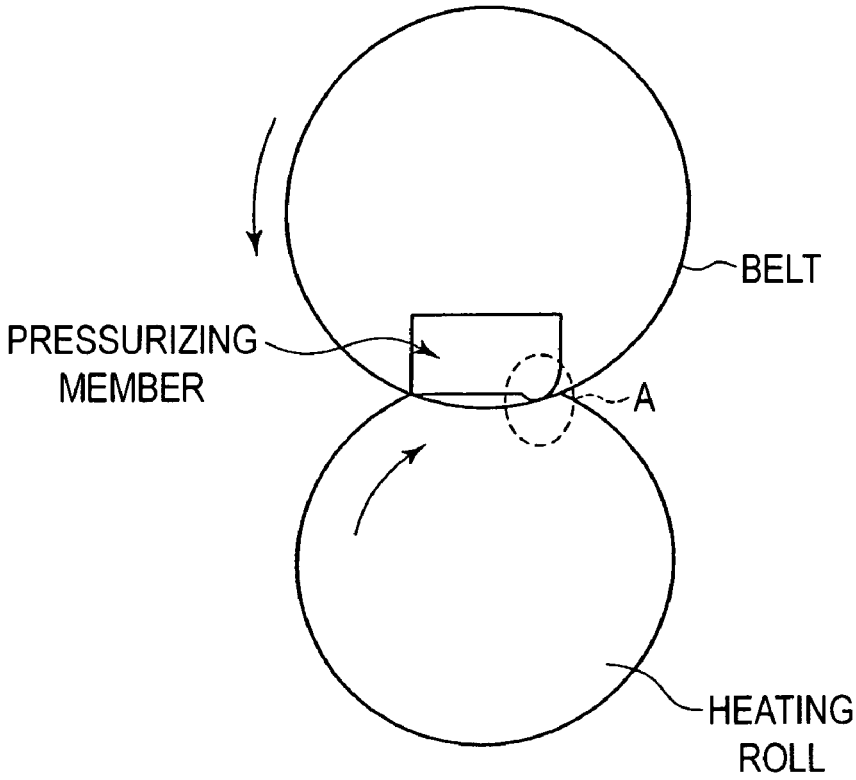
FIG. 29 is a diagram for explaining how winding of a recording sheet occurs in the conventional fixing device.

FIG. 27 is a cross-sectional schematic diagram for explaining an image forming apparatus according to Modified Example 3. According to Modified Example 3, instead of the single roll paper unit 9 of Embodiment 3, multiple (three) roll paper units 9*a* to 9*c* are mounted to the image forming apparatus. Roll recording papers a to c of different types (for example, different in the length along the roll axis direction) are respectively retained in the roll paper units 9*a* to 9*c*.

EXPERIMENTAL EXAMPLE 4

The following printing test is performed with the image forming apparatus according to Modified Example 1. The settings employed for the belt fixing device 7 at this time are described below. Winding of the recording sheet onto the fixing device 7 did not occur and high gloss prints were obtained.

The heating roll 71 uses a hollow roll made of aluminum (diameter: 44 mm, thickness: 7 mm) as its core portion. The resilient layer of the heating roll 71 is formed to have a JIS-A hardness of 40° and a thickness of 3 mm, whereas the releasing layer thereof is formed of PFA to have a thickness of 30 μm. The pressurizing roll 72 is constructed in the same manner as the heating roll 71. As the fixing belt 73, its base material is formed of polyimide having a thickness of 80 μm, and silicone rubber is coated on the base material at a thickness of 30 μm as the releasing layer. The fixing temperature is set as heating roll: 125° C./pressurizing roll: 125° C. (@resin coated paper). As the heat sink, one made of aluminum which is 330 mm in length, 50 mm in height, and 100 mm in width is used, and also an axial fan with an air flow rate of 0.4 $m^3$/min is used as the fan.

EXPERIMENTAL EXAMPLE 5

In addition to the roll paper 90 used in Embodiment 2, a roll paper whose thermoplastic resin layer 90*a* is inwardly rolled is prepared and left to stand for one night and day under the environment of 28° C. and 85% RH, and then printing was performed. When printing was performed by thus using the receding paper 90 having an inwardly rolled thermoplastic layer 90*a*, a reduction in density and density unevenness occurred in the image on the recording sheet 90. Furthermore, some paper jam was observed in the fixing device 7.

When the amount of moisture (hereinafter referred to as the "moisture content") contained in the recording sheet is measured, it was 9.4%. Thus, it was confirmed that the moisture content of the recording sheet was increased in comparison to the moisture content of 8.0% that is a moisture content of the recording sheet according to the JIS standard (under the environment of 23° C. and 50% RH) as well as the moisture content of 8.2% obtained in the case where the resin is outwardly rolled. Thus, by outwardly rolling the thermoplastic resin, it is possible to realize a construction in which the recording sheet does not easily absorb moisture, making it possible to prevent occurrence of problems associated with the inclusion of moisture.

As described above in detail, according to one effect of the present invention, the invention can provide an image forming apparatus in which the front and reverse sides of recording sheet are not easily mistaken and erroneously set the other way around. According to another effect of the invention, the invention can provide an image forming apparatus in which a shortage of paper trays is not liable to occur. According to yet another effect of the invention, the invention can provide an image forming apparatus which can prevent moisture from being contained in the recording sheet.

What is claimed is:

1. An image forming apparatus, comprising:

a sheet feeding portion that feeds a recording sheet, the sheet feeding portion comprising a roll sheet feeding portion arranged to feed a continuous recording sheet having a resin layer on at least one surface;

an image forming portion that forms a toner image on the resin layer on the at least one surface of the recording sheet fed by the sheet feeding portion; and a smoothing fixing portion including a fixing belt, the smoothing fixing portion fixing the toner image to the recording sheet by bringing the at least one surface having a resin layer into close contact with the fixing belt and then cooling the recording sheet to peel the recording sheet from the fixing belt.

2. An image forming apparatus according to claim 1, wherein:

the sheet feeding portion includes multiple roll sheet feeding portions; and the multiple roll sheet feeding portions feed continuous recording sheets having different sizes in a direction of a roll shaft.

3. An image forming apparatus according to claim 1, wherein the sheet feeding portion further comprises:

a standard-size sheet feeding portion that feeds a standard-size recording sheet that is placed flat, and wherein the recording sheet fed to the image forming portion is selectively fed from one of the continuous recording sheet of the roll sheet feeding portion and the standard-size sheet feeding portion.

4. An image forming apparatus according to claim 1, wherein the roll sheet feeding portion is detachably mountable to a main body of the image forming apparatus.

5. An image forming apparatus according to claim 1, wherein the roll sheet feeding portion includes a roll retaining portion to rotatably retain the continuous recording sheet wound into a roll shape.

6. An image forming apparatus according to claim 1, wherein the roll sheet feeding portion includes:

a roll retaining portion for rotatably retaining the continuous recording sheet wound into a roll shape;

a roll transporting portion arranged to transport the continuous recording sheet from the roll retaining portion; and a cutting portion arranged to cut the continuous recording sheet transported by the roll transporting portion into a desired size.

7. An image forming apparatus according to claim 1, wherein the continuous recording sheet is wound into a roll shape with the resin layer facing outward.

8. An image forming apparatus according to claim 1, wherein the resin layer is made of a thermoplastic resin.

9. An image forming apparatus according to claim 1, wherein the smoothing fixing portion includes a cooling portion, the cooling portion including a flat region for retaining the sheet flat, and cooling the recording sheet from at least one side surface thereof in the flat region.

10. An image forming apparatus according to claim 9, wherein the cooling portion further comprises a heat sink including the flat region.

11. An image forming apparatus according to claim 1, the smoothing fixing portion further comprising:

a heating roll;

a tension roll, the fixing belt being an endless belt rotatably stretched around the heating roll and the tension roll;

a pressurizing rotating member that is press-contacted with the heating roll through the endless fixing belt; and a heat sink that contacts a flat region arranged on a downstream side of the heating roll in a rotation direction of the endless fixing belt, wherein the recording sheet is brought into close contact with the endless fixing belt in a press-contact portion between the heating roll and the pressurizing rotating member, and transported and cooled while being in close contact with the endless fixing belt.

12. An image forming apparatus according to claim 1, the roll sheet feeding portion comprising:

a roll retaining portion arranged to removably retain the continuous recording sheet wound into a roll; and a reverse mounting prohibiting portion arranged to cooperate with the removable continuous recording sheet wound into a roll to regulate a mounting direction of the continuous recording sheet on the roll retaining portion so as to transport the continuous recording sheet from the roll retaining portion with the resin layer of the continuous recording sheet in a predetermined orientation.

* * * * *